US007176632B2

(12) United States Patent
Lenef et al.

(10) Patent No.: US 7,176,632 B2
(45) Date of Patent: Feb. 13, 2007

(54) SLOTTED ELECTRODE FOR HIGH INTENSITY DISCHARGE LAMP

(75) Inventors: Alan L. Lenef, Belmont, MA (US); Helmar Adler, Danvers, MA (US); A. Bowman Budinger, Westford, MA (US); Yan Ming Li, Lincoln, MA (US)

(73) Assignee: Osram Sylvania Inc., Danvers, MA (US)

( * ) Notice: Subject to any disclaimer, the term of this patent is extended or adjusted under 35 U.S.C. 154(b) by 106 days.

(21) Appl. No.: 11/080,289

(22) Filed: Mar. 15, 2005

(65) Prior Publication Data

US 2006/0208635 A1 Sep. 21, 2006

(51) Int. Cl.
*H01J 17/18* (2006.01)

(52) U.S. Cl. ..... 313/625; 313/624; 313/623; 313/260

(58) Field of Classification Search ..... 313/625, 313/624, 623, 621, 626, 620, 260, 261
See application file for complete search history.

(56) References Cited

U.S. PATENT DOCUMENTS 3,248,586 A 4/1966 Schlegel
3,248,591 A 4/1966 Arndt
3,303,377 A 2/1967 Jansen
3,930,176 A * 12/1975 Panico ..... 313/625
4,117,367 A * 9/1978 De Bie et al. ..... 313/352
5,327,045 A * 7/1994 Fox ..... 313/631
6,211,615 B1 4/2001 Altmann
6,437,509 B1 8/2002 Eggers
2002/0195941 A1 * 12/2002 Yang ..... 313/625

* cited by examiner

*Primary Examiner*—Tuyet Thi Vo
(74) *Attorney, Agent, or Firm*—William E. Meyer

(57) ABSTRACT

Operation of an HID lamp may be improved by forming a glow generating recess on an exterior side the electrode. The lamp may be of standard construction with a light transmissive lamp envelope having a wall defining an enclosed volume. At least one electrode assembly is extended in a sealed fashion from the exterior of the lamp through the lamp envelope wall to be exposed at an inner end of the electrode assembly to the enclosed volume. A metal halide lamp fill is enclosed with an inert fill gas. The inner end of the electrode is formed with a recess having a least spanning dimension S and a recess depth of D where S is greater the electron ionization mean free path but less than twice the cathode fall plus negative glow distances, throughout the glow discharge phase of starting, for the chosen fill gas composition and pressure (cold).

19 Claims, 15 Drawing Sheets

TABLE 1. (ALL DIMENSIONS IN MM; TF=THORIA-FREE.)

| LAMP MATERIAL (TYPE DESIGNATION) | ELECTRODE (EMITTER) | $N_s$ | $d_s$ | $h_s$ | $h_h$ | $d_1$ | $d_2$ | $h_1$ | $h_2$ | $T_0$ (K) | $K_{stab}$ (SINE-WAVE) (EQ. 11B) | $K_{stab}$ (SQ-WAVE) (EQ. 11B) |
|---|---|---|---|---|---|---|---|---|---|---|---|---|
| QUARTZ (HQI) | COILED ($ThO_2$) | - | 0.9 | 8.5 | - | 0.9 | - | - | - | 1000 | - | - |
| QUARTZ (HQI) | SOLID (TF) | - | 0.8 | 4.6 | 1.5 | 1.5 | - | - | - | 1000 | 1.15 | 0.58 |
| QUARTZ (HQI) | SLOTTED (TF) | 2 | 0.8 | 4.6 | 1.5 | 1.5 | 0.7 | 0.3 | 0.3 | 1000 | 1.11 | 0.56 |
| QUARTZ (HQI) | COILED (TF) | - | 0.8 | 8.5 | - | 0.8 | - | - | - | 1000 | 1.42 | 0.71 |
| CERAMIC (HCI) | COILED (TF) | - | 0.75 | 5.4 | 1.3 | 1.01 | - | - | - | 1500 | 0.93 | 0.47 |
| CERAMIC (HCI) | SOLID (TF) | - | 0.7 | 4.6 | 1.5 | 1.3 | - | - | - | 1500 | 0.65 | 0.33 |
| CERAMIC (HCI) | SLOTTED (TF) | 2 | 0.7 | 4.6 | 1.5 | 1.3 | 0.6 | 0.3 | 0.3 | 1500 | 0.63 | 0.32 |

FIG. 4

| LAMP | ELECTRODE TYPE | GTA TIME (SEC) | GTA ENERGY (J) |
|---|---|---|---|
| 2277 | STD. COILED | 0.5 | 59.6 |
| 2278 | STD. COILED | 0.26 | 39.5 |
| 2003-01 | STD. COILED | 0.5 | 58.7 |
| 2003-02 | STD. COILED | 0.3 | 45.2 |
| 2003-03 | STD. COILED | 0.3 | 40.3 |
| 2003-04 | STD. COILED | 0.3 | 40.2 |
| | AVERAGE | 0.36 | 47.2 |
| | SD | 0.11 | 9.45 |
| 2279 | SOLID TIP | 0.8 | 85.3 |
| 2280 | SOLID TIP | 0.8 | 86.6 |
| 2003-05 | SOLID TIP | 0.8 | 109.4 |
| 2003-06 | SOLID TIP | 0.7 | 86.8 |
| 2003-07 | SOLID TIP | 0.8 | 90.5 |
| 2003-08 | SOLID TIP | 0.8 | 112 |
| | AVERAGE | 0.78 | 95.1 |
| | SD | 0.04 | 12.2 |
| 2281 | SLOTTED TIP | 0.28 | 44.1 |
| 2282 | SLOTTED TIP | 0.37 | 37.6 |
| 2003-09 | SLOTTED TIP | 0.175 | 35.1 |
| 2003-10 | SLOTTED TIP | 0.38 | 53.6 |
| 2003-11 | SLOTTED TIP | 0.38 | 43.6 |
| 2003-12 | SLOTTED TIP | 0.22 | 29 |
| | AVERAGE | 0.30 | 39.8 |
| | SD | 0.09 | 8.6 |

FIG. 7

SLOTTED ELECTRODE FOR HIGH INTENSITY DISCHARGE LAMP

FIELD OF THE INVENTION

The invention relates to electric lamps and particularly to high intensity discharge lamps. More particularly the invention is concerned with electrodes for use in high intensity discharge lamps.

DESCRIPTION OF THE RELATED ART INCLUDING INFORMATION DISCLOSED UNDER 37 CFR 1.97 AND 1.98

BACKGROUND OF THE INVENTION

It is common for an arc discharge lamp to have an electrode with a massive head formed on the interior end of a rod. For example, many metal halide high-intensity discharge lamps use an electrode with a straight tungsten rod wrapped with a coil to form the head. During operation the wrapped head provides a larger area from which thermionic electrons are emitted, resulting in a more durable electrode that operates at lower temperatures. Unfortunately, the massive head is difficult to heat initially and lamp starting may suffer. If the wrapped head is too large, a high temperature spot mode arc attachment can occur that degrades the steady-state operation of the lamp, especially when no emitter material is used. Coil wrapped electrodes can also have large performance variabilities, likely due to the variable heat connection between the rod and coil. All of these effects can result in excessive electrode evaporation and sputtering. The evaporated electrode material then blackens the arc tube walls. There is then a need for an electrode with good starting features and good heat control.

One method to improve starting and lower the temperature of the electrode head is to include thoria in the electrode. Use of thoriated electrodes in metal-halide, high-intensity discharge (HID) lamps can result in excellent color and high-efficacy in a small volume with an electrode lifetime of 8,000 to 20,000 hours. Typically, this long lifetime or high-maintenance is achieved by doping the electrodes with thoria emitter to reduce the work function of the electrode and therefore lower the electrode temperature. However, thoria is felt to be environmentally undesirable. Removal of thoria is especially difficult in general lighting applications using metal-halide lamps where the electrode must function well for starting and during steady-state alternating-current (AC) operation and the resulting evaporation. There is then a need for a thoria free electrode with good starting and with good steady-state characteristics The most common approach to achieve good lifetime with a non-thoriated electrode is to use the conventional coiled electrode configuration, but without the use of emitter materials. Such an electrode consists of a tungsten rod with a tungsten coil wrapped around the rod, usually near the tip. In the cathode phase, the additional surface area of the coil provides additional arc attachment area, provided the electrode operates in a diffuse attachment mode. This lowers the tip temperature because less thermionic emission is needed to supply the needed current. In the anode phase, the tip temperature is determined primarily by the balance of heat input from recombination of hot plasma electrons with bulk metal of the electrode and the radiation and conductive losses down the electrode stem. During the first few seconds of the starting phase, the coil also provides an attachment region for the glow phase and subsequent thermionic phase.

Thoria free electrodes have been shown to give reasonable performance when rare-earth/alkali metal halide fills are used, particularly with ceramic arc tubes. This appears to be the result of the rare earth or alkali vapor functioning as an emitter material. However, an electrode that has a relatively low electrode tip temperature without thoria emitters for a broad range of metal halide fills and lamp types is highly desirable.

The coil and rod approach to a thoria-free electrode has a number of disadvantages however. The most significant is that coil-rod system is not well suited to large tip areas. First, the poor thermal interfaces between coil windings and the coil and rod cannot transfer heat efficiently, particularly when the components are large. The interfaces can then induce regions of localized heating. The increased thermionic emission from the hotter regions increases the local heat flux and can result in undesirable spot arc attachment. This mode of operation has very high, localized temperatures for tungsten electrodes without emitters, and leads to excessive evaporation of electrode material, and flickering of the arc The second problem with large coils is slow starting. The power deposition into the massive coil and rod is not large enough to rapidly raise the tip temperature to high enough values for good thermionic emission. The massive electrode coil can let the discharge linger in the glow stage. This is particularly troublesome without an emitter to reduce the glow-to-arc transition temperature. U.S. Pat. No. 6,614,187, describes a short arc mercury lamp with a coil configuration with good contact to the rod while a second part of the coil does not contact the rod. This improves the glow-to-arc transition and transfer of thermionic emission to the rod during starting. However, the coil construction is complicated, requiring steps to sinter or melt tungsten powder between rod and coil and special coil winding steps to produce a graded coil diameter.

Other approaches to thoria-free electrodes have been disclosed which use alternative non-radioactive emitter materials. U.S. Pat. No. 5,712,531 Rademacher, describes the use of a lanthanum oxide emitter in a 2000-Watt metal-halide lamp. This emitter material is not chemically stable with many light-emitting metal-halide fills and evaporates much more rapidly than thoria, thus having limited use for long-life general lighting applications. The emitter is also supplied as a pellet that must be enclosed in an electrode coil, adding to cost and complexity. U.S. Pat. No. 3,916,241 Pollard, describes the use of a recess in the tip to form a dispenser of emitter material for a mercury arc lamp. The use of non-thoriated emitters have the same disadvantages as Rademacher in metal-halide discharge lamps and the recess is used only to protect the emitter from direct contact by the discharge stream. U.S. Pat. No. 6,046,544 Daemen, discloses a three-component emitter in which the emitter material is supplied as a sintered electrode or as a pellet. As stated in Daemen, the sintered form is not useful in many applications because of depletion by evaporation. The pellet form also requires additional structure to support it.

Approaches to non-radioactive electrodes based on different electrode structures without any additional emitter materials are disclosed in WO 01/86693 Theodorus; EP 1 056 115 Yoshiharu; WO 03/060974 Haacke; and U.S. Pat. No. 6,437,509 Eggers. Theodorus discloses the use of emitter-free tungsten materials in which a second tungsten filament coil is completely enclosed by the primary tip coil to aid starting without the use of emitter materials. The configuration reduces tungsten sputtering because of the enclosing space of the primary coil. While this configuration improves starting maintenance, the manufacturing complexity and basic issues associated with a coil at the tip are not resolved.

The Yoshiharu patent describes an improvement to the standard rod and coil electrode by replacing the coil with a solid emitter-free tungsten cylinder that is welded to the rod. This overcomes many of the problems associated with the coil at the tip. The electrode in Yosiharu cannot reach the large optimal tip area because heating such a large electrode mass during the starting phase causes a long glow-to-arc transition over a large electrode surface area. This results in excessive tungsten sputtering that blackens the lamp. Haacke discloses a similar electrode having a large solid head for automotive discharge lamps. In this design, the head is partially fused to the quartz arc tube. The design prevents overheating during the high-current instant-light requirement for automotive applications, but is not readily adaptable to higher-wattage general lighting situations where the glow-to-arc transition would be difficult. Additionally, automotive HID lamps operate at very high pressures that reduce wall blackening and have lower life requirements than general lighting HID lamps. Eggers discloses configurations in which the use of single or multiple solid cooling bodies surround a tungsten rod and are laser-welded to the rod. However, unless special lamp and electrode conditions are met, the structure in Eggers has similar starting difficulties under conditions when tip area is large. A cooling structure similar to Egger's is also disclosed in U.S. Pat. No. 6,211,615 Altmann, but again without mention of special lamp and electrode conditions needed to improve starting. Furthermore, all of these disclosures do not disclose the special electrode, lamp, and ballast conditions necessary for achieving improved steady-state maintenance without spot attachment.

Accordingly, there exists a need for an electrode that provides improved steady-state maintenance by increasing the tip area without spot attachment while simultaneously having good starting maintenance. This is particularly true for higher current electrodes. Additionally, optimal performance electrodes should have the advantages of reduced manufacturing variability and have simple structures for optimization by computer simulation. There is a need for an electrode with good life, and maintenance in a dimming operation mode.

BRIEF SUMMARY OF THE INVENTION

A high intensity discharge lamp may be formed with a glow generating recess on the exterior side or sides of the electrode head. The lamp may be of standard construction with a light transmissive lamp envelope having a wall defining an enclosed volume. At least one electrode assembly is extended in a sealed fashion from the exterior of the lamp through the lamp envelope wall to be exposed at an inner end of the electrode assembly to the enclosed volume. A light emitting lamp fill is also enclosed with an inert fill gas. The inner end of the electrode is formed with a recess having a least spanning dimension S and a recess depth of D where S is greater than the electron ionization mean free path but less than twice the cathode fall distance plus the negative glow distance, throughout the glow discharge phase of starting, for the chosen fill gas composition and pressure (cold). The recess spanning distance S of the electrode is less than the recess depth D. The outside diameter of the inner end (head) $d_h$ of the electrode is made as large as possible to reduce the electrode tip temperature thereby minimizing evaporation of tungsten onto the inner wall of the lamp envelope during steady-state operation of the lamp. By making the ratio of the product of the head diameter $d_h$ and head heat conductivity $K_h$ to the product of the shaft diameter $d_s$ and shaft heat conductivity $\kappa_s$ much larger than one, transitions to an undesirably high spot arc attachment temperature can be avoided and higher maintenance of the lamp can be achieved.

BRIEF DESCRIPTION OF THE SEVERAL VIEWS OF THE DRAWINGS

FIG. 4 shows a table of relevant dimensions and operating conditions for lamps with electrodes with standard forms and electrodes with the general form (slotted) of FIG. 3.

FIG. 7 shows a table of glow to arc (GTA) times and energies for lamps with standard electrodes and electrodes with the form shown in FIG. 3.

DETAILED DESCRIPTION OF THE INVENTION

Figure 1:
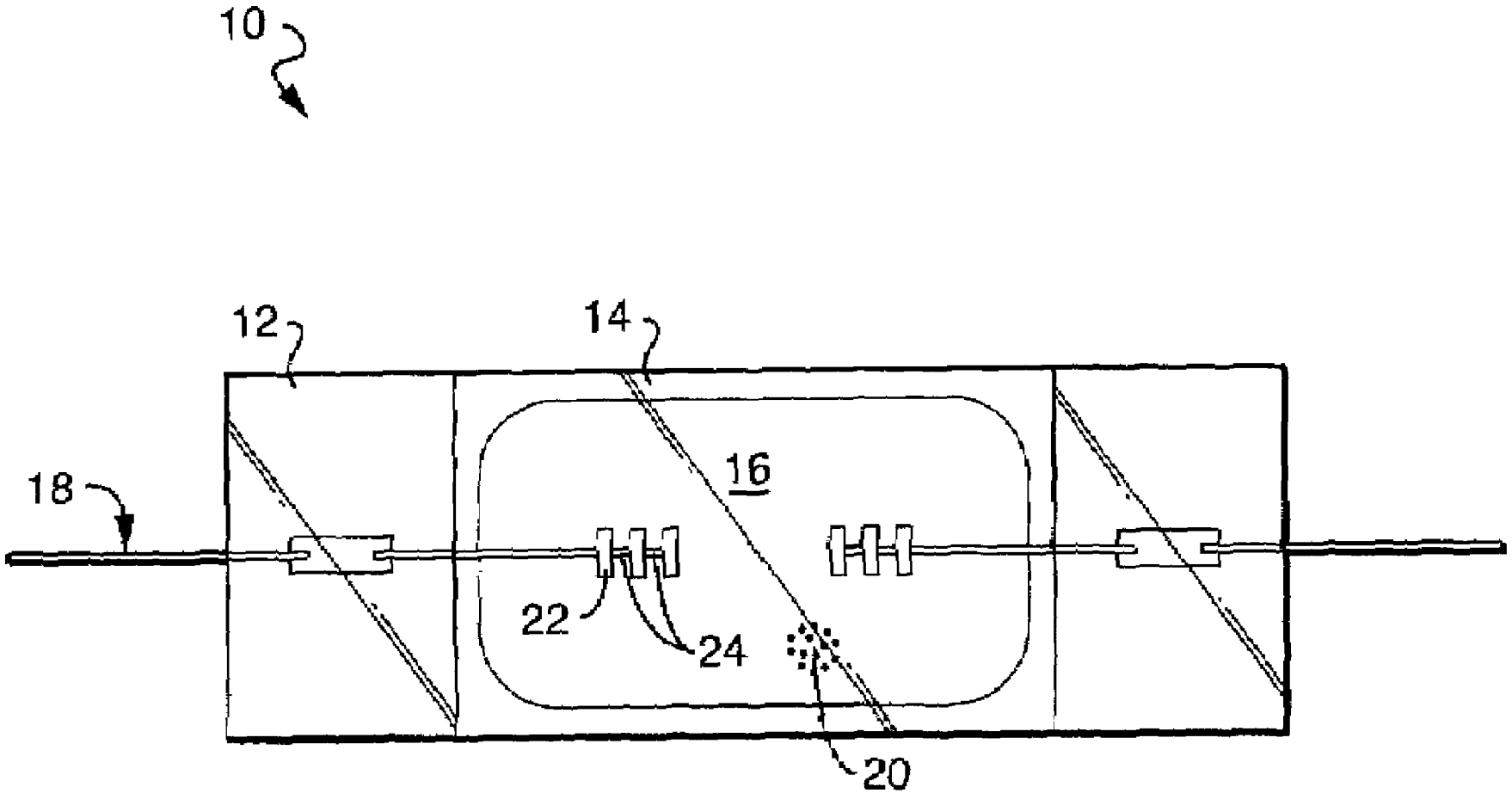
FIG. 1 shows a cross-sectional view of an arc discharge lamp.

FIG. 1 shows a cross-sectional view of an arc discharge lamp 10. A high intensity discharge lamp 10 with improved starting and steady-state maintenance may be made from a light transmissive lamp envelope 12 having a wall 14 defining an enclosed volume 16. At least one electrode assembly 18 is extended in a sealed fashion from the exterior of the envelope 12 through the lamp wall 14 to be exposed at an inner end of the electrode assembly to the enclosed volume 16. Enclosed in the envelope volume 16 is also a lamp fill 20 including an inert fill gas. The fill gas has a cold fill pressure of p in Pascals. The electrode assembly 18 has an inner end formed with a head 22 including one or more glow discharge stimulating recess(es) 24 having a least spanning dimension S and a recess depth of D.

The envelope 12 may be formed from a light transmissive material such as quartz, polycrystalline alumina (PCA), sapphire or similar discharge lamp envelope material as known in the art. The particular envelope material is matter of design choice. The Applicants prefer quartz or molded PCA.

Enclosed in the enclosed volume 16 is a fill 20. The fill 20 may include a metal halide or similar dopant composition as known in the art. The invention is especially useful for starting of mercury free lamps, so that little or no mercury can be used in the fill 20. The described electrode head 22 construction may also be used with mercury fill components. Included in the fill is an inert gas. Argon, krypton, xenon, and other gases and combinations thereof are commonly used in the art as inert fill gases. Argon is preferred because it is generally the least expensive, although xenon may be preferable in mercury free compositions because of its lower thermal conductivity. The fill gas has a cold (32 degrees Celsius) fill pressure p measured in Pascals. In general the preferred fill pressure p is a few kilo Pascals (kPa) to a few tens of kilo Pascals (kPa).

Inserted through the envelope wall 14 in a sealed fashion are at least one and preferably two electrodes 18. The electrode 18 extends axially from the lamp envelope exterior, through the envelope wall 14 to be exposed at an inner most end at head 22 to the enclosed volume 16. In quartz arc tubes, the preferred electrode 18 has an exterior end formed from a molybdenum rod. The preferred middle portion of the electrode assembly is made of a molybdenum foil as is known in the art and is sealed to envelope 12 to form a gas tight seal. In ceramic arc tubes, the middle portion of the electrode feedthrough assembly as is known in the art may consist of an electrode welded to a cermet or molybdenum rod that is further welded to a niobium rod that forms a gas tight seal in a ceramic capillary section of the arc tube that is exterior to the lamp. Extending into the enclosed volume 16 is an inner end of the electrode, preferably made of solid, thoria free tungsten, including head 22. The inner electrode portion may also be formed with thoria-doped tungsten, but the preferred utility is in the fact that thoria doping may be avoided.

An electrical ballast energizes the complete lamp. The ballast must be capable of supplying electrical power at a sufficient voltage and current to break down the fill gas for arc discharge and provide a high enough open-circuit voltage to maintain a glow discharge during startup. The ballast should also apply a fixed or regulated rms current during steady-state operation to run the lamp at the desired power. The waveform may be direct-current (DC) or alternating-current (AC) or the various know variations thereof. The exact AC waveform shape is not believed to be critical as to the electrode operation; however, square-wave operation in particular may have certain advantages over sine-wave operation with respect to arc attachment and maintenance. DC operation may have even further advantages in some applications.

Figure 2:
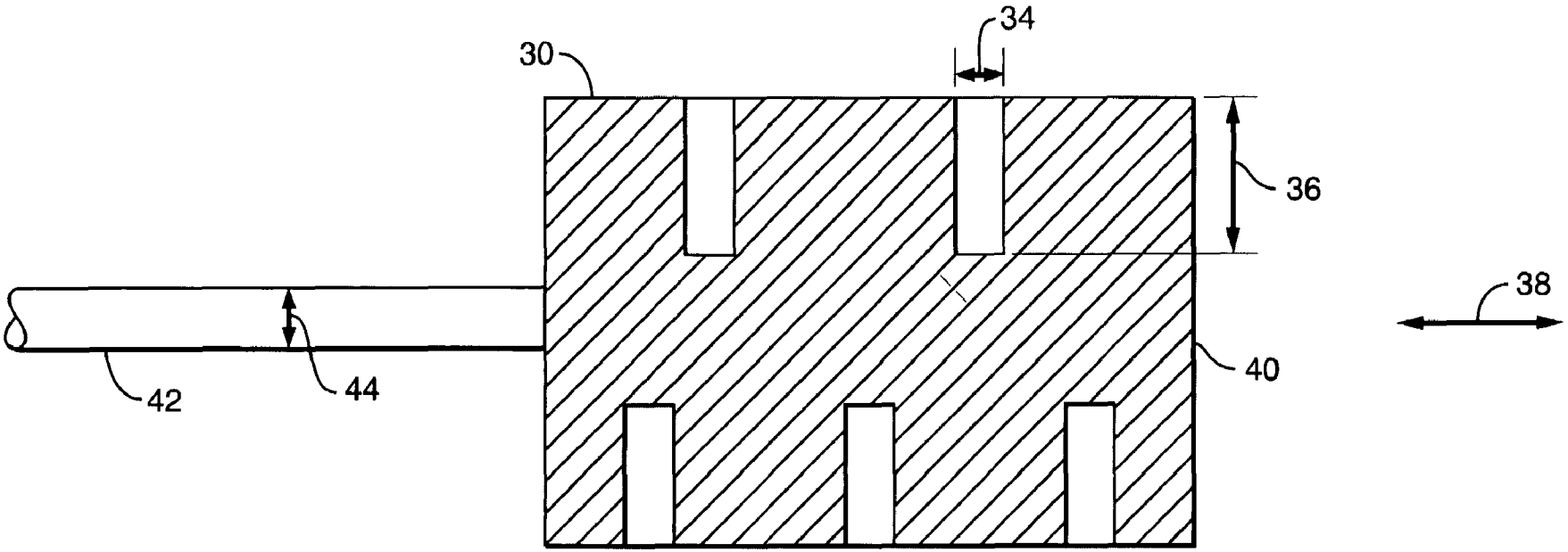
FIG. 2 shows a cross-sectional view, partially broken away, of a generic electrode head with a glow generating recess.

FIG. 2 shows a cross-sectional view, partially broken away, of a generic electrode head 30 with a glow generating recess 32. The head 30 is formed as an integral body with an exterior surface that defines an axial side recess 32 region to stimulate a high current (hollow cathode) glow discharge during startup. The recess 32 opens on the enclosed envelope volume at an opening end. In the preferred embodiment, the recess 32 includes internal wall portions defining a relatively deep cavity with an axial midline (in the case of a bore like recess) or midplane (in the case of a groove like midline) as the case may be. In the preferred embodiment, the recess 32 defines internal sidewall portions with normals of 45 degrees or more to the recess midline or midplane as the case may be. Ideally the sidewall normals are perpendicular to the midline or midplane as the case may be, for example in a perpendicularly drilled bore or vertically milled groove. The recess sidewalls have a surface area $A_r$ providing electron emission. The least spanning distance S of the recess is the least distance normal to the midline or midplane crossing at the recess opening. For a vertically drilled bore the spanning distance S is the bore diameter. For a vertically cut groove, the spanning distance S is the cross groove width. For recesses with curved or beveled openings, the spanning measurement is taken as the least spanning diameter where the curved opening sidewalls have normals of 45 degrees or more from the midline or midplane. The preferred recess sidewalls then define a cavity that is maximally deeper than it is minimally wide, like a deep hole or narrow crack. The recess 32 has a least spanning dimension 34, measured parallel to the head 30 surface adjacent the recess opening. The spanning distance 34 is then the least distance across the center point of the recess 32 at the electrode head 30 surface.

The least spanning dimension defines a distance S measured in centimeters. The preferred spanning distance 34 is determined in part by the fill gas material and the fill gas pressure. The preferred spanning distance 34 is equal to or greater than the maximum electron ionization mean free path but less than twice the minimum cathode fall distance plus the negative glow distance, during the glow discharge phase of starting, all for the chosen fill gas composition and (cold) fill gas pressure. The mean free electron path is commonly computed, and it depends on the fill gas composition and local density of the gas near the electrode. The minimum cathode fall distance and the negative glow distance are measured as if from a similarly formed electrode head without a recess and operated under similar fill and pressure conditions. The largest lower bound on the spanning distance during the starting phase is dictated by the electron mean free path at thermionic electrode temperatures (2200 K to 3000 K typically). The ideal gas law and known ionization cross-sections easily determine this. The size of the recess spanning distance 34 is chosen to ionize the fill gas material in the recess 32 during start up. However, it is equally preferred that the recess 32 be sufficiently narrow that sputtered material remain substantially in the recess 32 and not migrate through a large exit opening to enter the enclosed volume 16 at large.

The recess 32 further has a depth 36, measured from the midpoint of the spanning distance 34, transversely toward the electrode axis 38. Depth 36 is the transverse depth of recess 32. The preferred recess 32 has a depth 36 that is as deep as possible without substantially interfering with desired heat conduction from the electrode tip 40 to the electrode stem 42. The deeper the recess 32 is, the more internal wall area is exposed to emit electrons and thereby generate more ions in the recess to sustain the glow discharge generation during start up. On the other hand if the recess 32 is too deep or too wide, the increased thermal resistance of the recessed section must be compensated by reducing the thermal resistance from the tip to the seal region in other regions of the electrode. In general, the least cross-sectional area taken through the head 30 and transverse to the electrode axis 38 is a design parameter that can be adjusted to suit individual design needs, so long as the overall thermal resistance of the electrode along the axis 38 is comparable to that of a standard electrode to thereby provide the correct conducted power to the seal at typical tip operating temperatures. The preferred depth 36 is then greater than the preferred spanning distance 34, (D>S), but is generally not so great as to reduce the structural integrity of the head at operating temperatures over the life of the lamp. It is preferred that the glow discharge be initiated symmetrically around the sides of the head 30, so there may be a plurality of individual recesses distributed evenly around the head 30, for example straight bores; or one or more elongated recesses may wrap round the head in a relatively symmetric fashion. Banded or spiral grooves may be used to form the recess(es). Grooves with parallel surfaces are preferred, but not necessary for enhancement of ionization by the cavity formed by the grooves. A conic or curved section may form the head, so the head need not be a right cylinder. Preferably, the cross-sectional area of the tip 40, the least cross-sectional area of the head 30, the stem 42 length and stem diameter 44 are adjusted to provide the least electrode evaporation while maintaining diffuse attachment during steady-state operation. In general, the outside diameter of the inner end 40 (head diameter=$d_h$) of the electrode is made as large as possible while making the ratio of the product of the head diameter $d_h$ and head heat conductivity $\kappa_h$ to the product of the shaft diameter $d_s$ and shaft heat conductivity $\kappa_s$ sufficiently large to satisfy certain minimal constraints, as described below, to avoid transitions to an undesirable, spot arc attachment during steady state operation. Such spot attachment can cause excessive evaporation of electrode material and subsequent wall blackening. However if the ratio becomes too large, the electrode tip overheats because of a reduction in cathode fall and therefore reduced Schottky effect and lower heat dissipation in the anode phase. Thus a preferred range of values exists that minimize electrode tip temperature.

Figure 3:
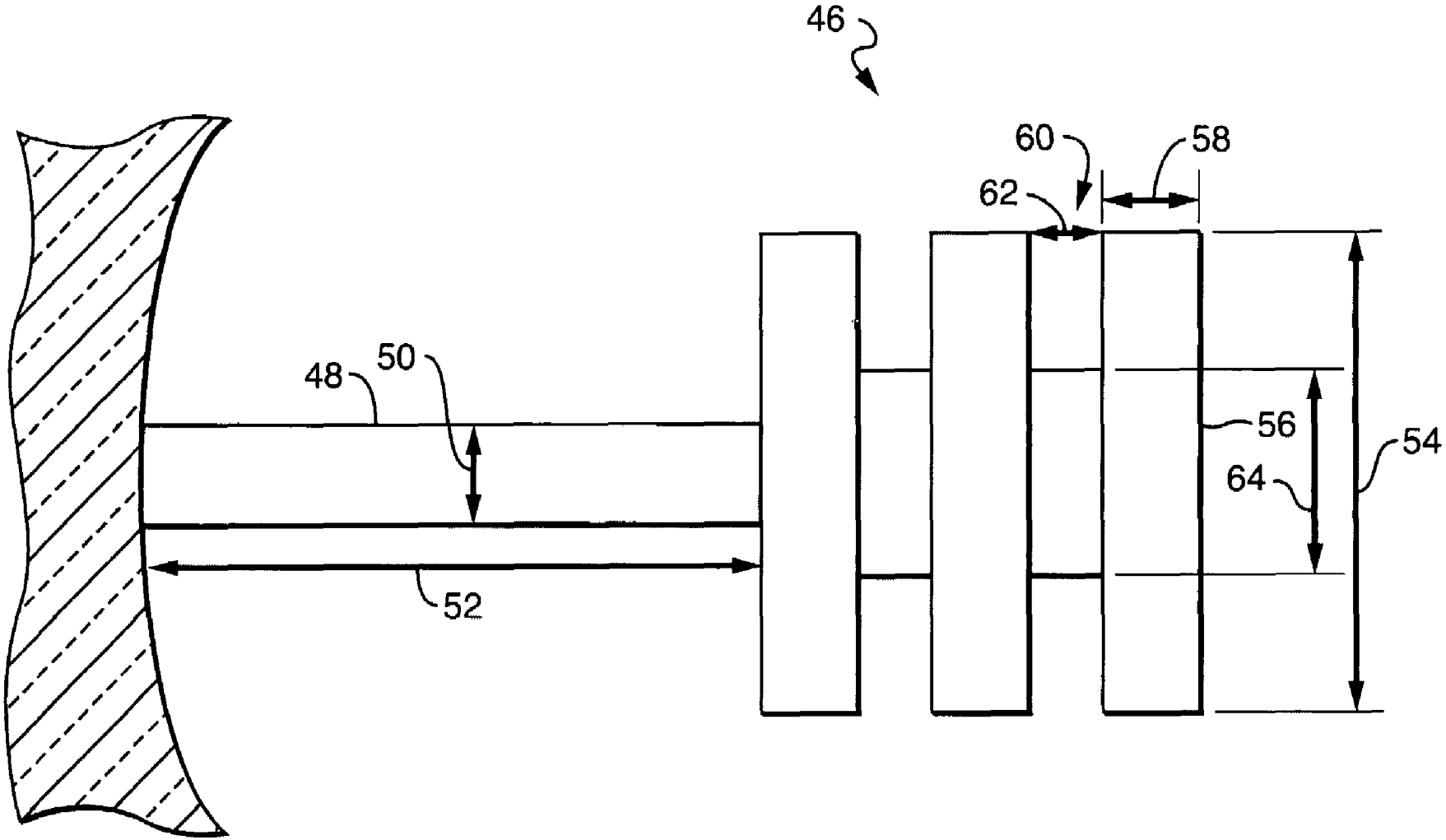
FIG. 3 shows a cross-sectional view, partially broken away, of a preferred electrode head with a glow generating recess.

FIG. 3 shows a cross-sectional view, partially broken away, of a preferred electrode head 46 with a glow generating recess. The embodiment in FIG. 3 is rotationally symmetric about the long axis. In a preferred embodiment, the electrode head 46 is made from a machined, thoria-free, tungsten body. In the current embodiment, the tungsten electrode is doped with approximately 60 to 70 parts per million of potassium by weight to help stabilize grain growth during lamp operation. Potassium doping is preferred to keep the electrode structure stable over lamp life. In the preferred embodiment, the electrodes are fabricated from a single piece of tungsten and shaped by standard grinding techniques using well-known hard abrasives including aluminum oxide, diamond, and cubic boron nitride to form one or more narrow grooves offset from the electrode tip. Laser ablation may also be used to machine the electrode head. The machined radial grooves then have adjacent walled portions that allow good heat conduction to the remaining core. Sintering of powder formed bodies is another fabrication approach, as disclosed in U.S. Pat. No. 6,211,615 Altmann, but may require additional compacting steps, such as hot isostatic pressing (HIP), to achieve sufficiently high densities for microstructural stability. The stem 48 has a stem diameter 50 (value=$d_s$) and an axial length 52 (value=$h_s$). Stem 48 is coupled to a generally cylindrically shaped head 46 with a greater outside diameter 54, (value=$d_1$). Machined in the side of the head 46, offset from the inner most tip 56 by a distance 58, (value=$h_1$), is at least one radial groove 60 with an axial width 62 (value=$h_1$). The radial groove 60 has an internal diameter 64 (value=$d_2$). The least spanning distance S is then the axial distance 62 (value=$h_2$) across the groove 60. The recess depth D is then one-half of the head diameter $d_1$ minus one-half of the inner diameter $d_2$ so that $D=(d_1-d_2)/2$.

There may be successive radial grooves similarly formed along the head 46, thereby creating a series of disk and groove sections along the head 46. Two grooves and three disks are shown in FIG. 3. If any of the disk sections is particularly thin, it may not conduct heat as well to the core or stem portions. The narrowest disk in a series then heats first and emits electrons more freely. The arc discharge can then undesirably attach to a rearward section of the head 46 if it is the narrowest (hottest) section. To assure the arc attaches to the tip 56 (preferred), the first disk portion 58 is preferred to have the least axial thickness (value=$h_1$). This is not a requirement for generating the glow discharge and the resulting improved starting, rather it is preferred for the steady-state lamp operation.

An important condition for operation of the electrode is that the recess 60 dimensions and rare-gas pressure are such that during starting a hollow-cathode type discharge forms in the defined recess 60 between the adjacent disk sections. The formation of a hollow-cathode discharge in the recess 60 has several advantages. The hollow cathode discharge has voltages similar to the more usual glow-discharge that forms around conventional electrodes, but can sustain a much higher current. A higher current increases the power deposition to the electrode during starting and shortens the glow-to-arc time. Power deposition is desirable for a large diameter tips, and consequently higher current electrodes, where the large thermal mass is difficult to heat by the typical glow to arc starting sequence. This is particularly helpful for mercury free fills where the formation of high-current vapor arcs is undesirable as they rapidly erode electrode material. In the case of mercury containing fills, vapor arcs generally form on condensed mercury droplets that do not affect the electrode and are desirable for starting by improving anode phase heating. A second advantage of the hollow cathode discharge is that a sputtered material tends to be deposited inside the recess 60 rather than on the arc tube wall. Thirdly, the arc attachment does not have to transfer from a coil to a different electrode structure during starting, thus providing a more controlled start and less likelihood of evaporation during starting.

Figure 5:
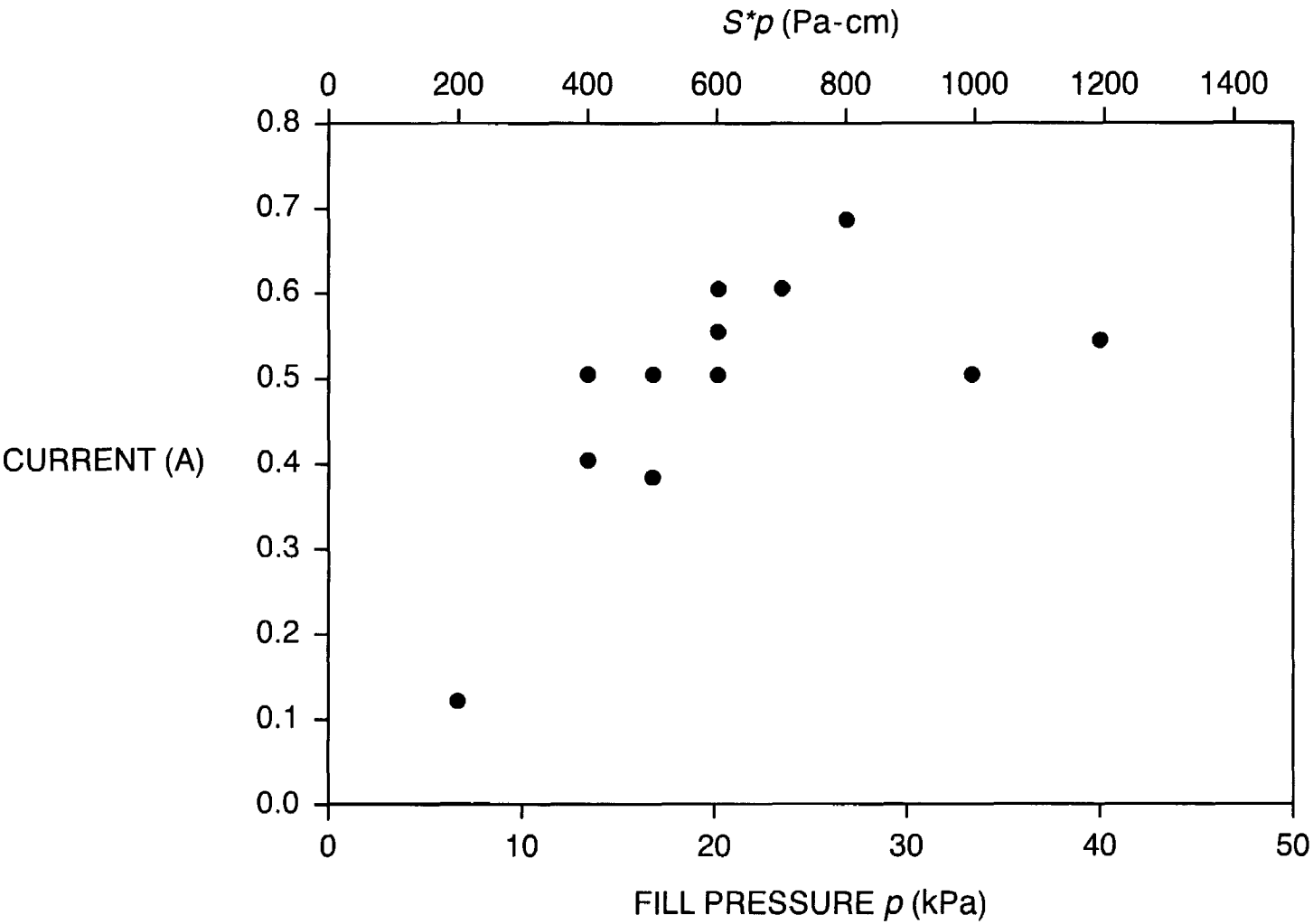
FIG. 5 shows a chart of the peak cathode current as a function of pressure for the embodiment in FIG. 3.
Figure 6:
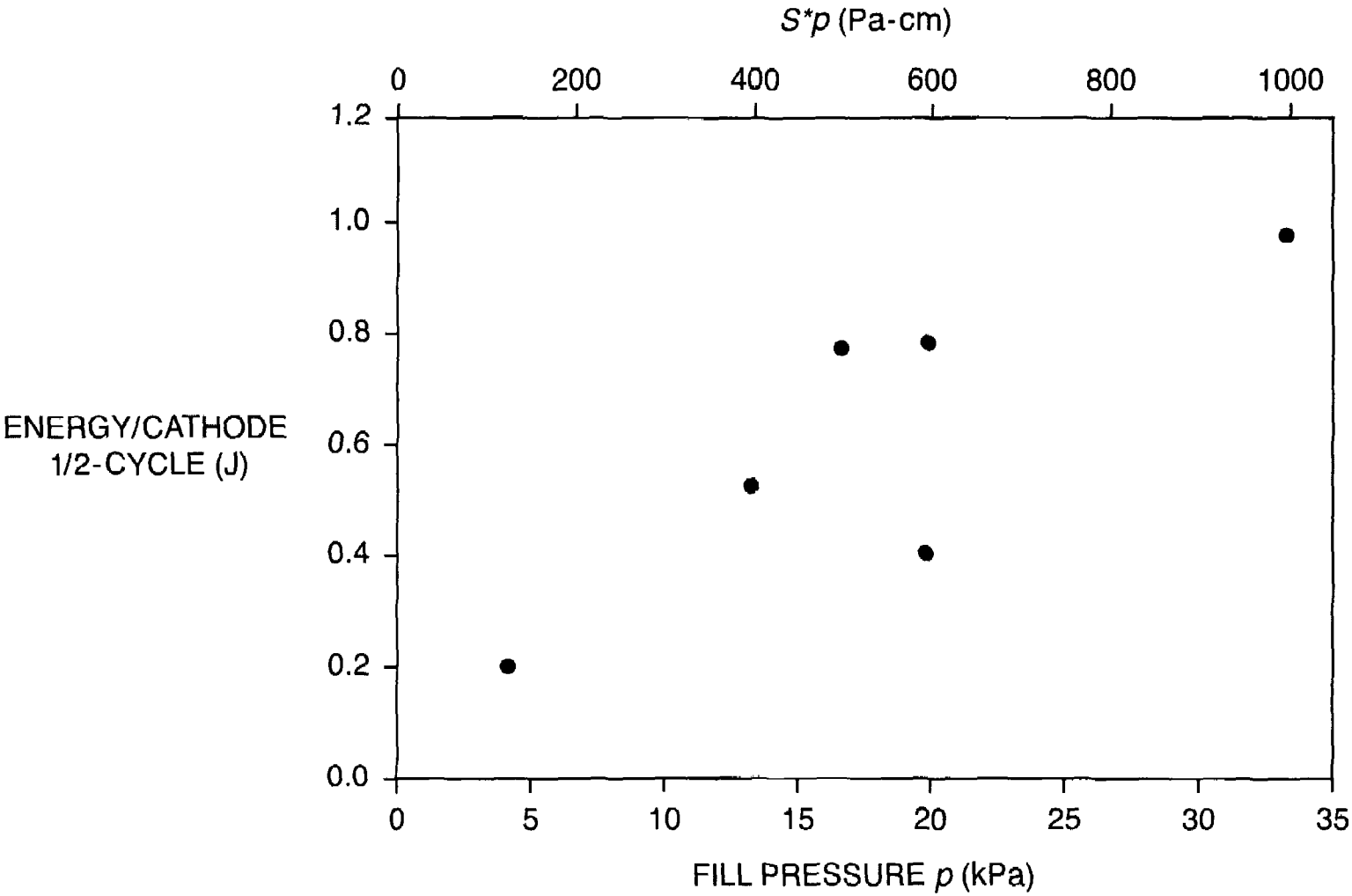
FIG. 6 shows a chart of the average one-half cycle cathode energy as a function of lamp pressure using an electrode of the type shown in FIG. 3.

The minimal requirement for producing a hollow-cathode discharge within the recess is that the least spanning distance S is such that secondary emitted electrons emitted from the interior recess wall (disk surface) towards the opposite side of the recess, (the next adjacent disk wall) on average have sufficient travel distance between the disks to have at least one ionizing collision before reaching the opposing electrode surface. As a maximal limitation, the least spanning distance S of the recess should not exceed the total depth of the negative glow distance plus two times the cathode fall distance, where the cathode fall distance is measured from what would otherwise be formed along the electrode tip (58) surface (first disk surface) of a similar recess free electrode under the same fill conditions. This recess distance condition should be maintained over the entire glow-to-arc transition, during which the electrodes heat from near room temperature ($T_{amb}$=300K) to typical thermionic temperatures ($T_{therm}$=2800K for non doped emitters). In the preferred embodiments, HQI lamps with slotted electrodes as in Table 1 (FIG. 4), a range of enhanced current and energy deposition was observed for the range of spanning distance (S) times the pressure (p) values (Sp) of between 120 Pa-cm to 1200 Pa-cm with the actual cold fill pressure variation being 4 to 40 kPa (30 to 300 torr) argon. Maximum energy deposition occurs in the range of 600–800 Pa-cm. Above 800 Pa-cm, energy deposition is still enhanced significantly but the voltage begins to increase, indicating the onset of the abnormal glow rather than a hollow-cathode glow. The increased voltage requirements increase complexity of the ballast design and are therefore less desirable. Above 800 Pa-cm, it was also more difficult to maintain the hollow-cathode discharge throughout the full glow-to-arc transition. These experimental results are shown in FIG. 5 and FIG. 6. FIG. 5 shows that the hollow cathode current for the HQI lamp with slotted electrode in Table 1 (FIG. 4) reaches a maximum of Sp of about 800 Pa-cm. FIG. 6 shows similar behavior in the hollow cathode energy.

For comparison of these (cold fill) Sp ranges to known literature values, the lower limit in Equation (1a) is within the theoretical order of magnitude of one estimate for argon, $Sp>3.5(T_{therm}/T_{amb})$ Pa-cm=33 Pa-cm, (where $T_{therm}$=2800 K, and $T_{amb}$=300 K) and close to one experimental limit of 70 Pa-cm for micro-hollow cathode discharges. An upper experimental limit for the micro-hollow discharges is about 670 Pa-cm. Known literature values are based on operating pressures in a flowing system and are comparable to the pressures used in the lamp experiments. The higher values observed here are probably from the different geometry of the slots whereas most published data comes from hollow cathode discharges formed in cylindrical holes or parallel plates. Based on these considerations for argon, the spanning distance S in centimeters and rare gas pressure p in Pascals should approximately satisfy the room temperature condition:

$$70<Sp<1200 \text{ Pa-cm} \qquad \text{Equation 1a—argon}$$

In addition, inert gases other than argon are useful for producing hollow cathode discharges; however Sp limits are not readily available in the literature. We can therefore obtain estimates of the Sp range for useful hollow cathode operation in the electrode recesses by scaling the lower and upper limits. The lower limit is inversely proportional to the ionization cross-section and can therefore be scaled according to readily available ionization cross-sections. For these estimates with other inert gases, the gas temperature and density is assumed fixed and the maximum cross-section values, which occur in the 50–200 eV, range are used. Estimating the upper Sp limit for other inert gases requires a separate estimate of the abnormal glow sheath distance $l_s$ and the negative glow distance $l_{ng}$ for each gas. Using the well-known von Engle-Steebeck model for the abnormal glow, we obtain a sheath thickness-fill pressure product of about $l_{sp}$=20 Pa-cm at a typical current density of 10 A/cm$^2$. If we subtract twice this amount from the upper Ar limit in Equation 1a—argon, we obtain a maximum negative glow distance-fill pressure product of 1160 Pa-cm. The negative glow distance is then scaled from the experimental argon value according to the following proportionality: $pl_{ng}\propto(1/\sigma_{ion})(V_c/V_{ion})$ where $\sigma_{ion}$ is the average ionization cross-section for the given inert gas, $V_c$ is the cathode fall in the abnormal glow and corresponds to the initial electron energy in the negative glow, and $V_{ion}$ is the ionization energy of the inert gas atom. The final upper Sp limit is obtained by adding twice the predicted sheath thickness-pressure product lsp as calculated from the von Engle-Steebeck model. Generally the sheath thickness-pressure product is considerably smaller than the negative glow-pressure product. The results of these estimates are given below for helium, neon, kyrpton, and xenon:

$$530<Sp<15000 \text{ Pa-cm} \qquad \text{(Equation 1a—helium)}$$

$$240<Sp<4800 \text{ Pa-cm} \qquad \text{(Equation 1a—neon)}$$

$$40<Sp<880 \text{ Pa-cm} \qquad \text{(Equation 1a—krypton)}$$

$$35<Sp<840 \text{ Pa-cm} \qquad \text{(Equation 1a—xenon)}$$

The preferred gases are argon, krypton, and xenon because of their lower ionization potential. This allows higher current densities to be achieved for given hollow-cathode voltages and therefore places less demand on the ballast. The lower ionization potential also reduces breakdown voltage requirements, again allowing for less costly ballasts. The lower Sp range is also more suitable for typical starting gas pressures and electrode dimensions.

The recess depth D should be sufficiently large to contain sputtered electrode material, typically tungsten, within the recess. In general, tungsten retention occurs when the recess depth D is greater than the minimal spanning distance S. The preferred recess is then relatively deeper than it is open, so material sputtered in the recess has a good opportunity to settle on the interior recess surfaces, and not exit the recess to settle elsewhere in the lamp. The preferred recess is also as deep as possible to maximize the current generated by the glow discharge. It is then preferred that the recess depth satisfies, $$S<D \qquad \text{Equation 1b}$$

Increasing the recess depth D increases the thermal resistance of that section of the electrode head; however, this does not necessarily cause overheating of the electrode tip. The increased thermal resistance of the head can nearly always be compensated by a decrease in the thermal resistance of other sections. For example, the shaft length 52 may be decreased. The overall thermal design of the electrode is covered in a later section on steady-state considerations. The main restriction on maximum recess depth is that the structural integrity of the electrode during operation over the life of the lamp is not compromised.

An important criterion for starting is that the heat input provided by the glow in the recess is somewhat greater than the time averaged heat input to the electrode during steady-state operation. This prevents the electrode from being under heated during starting and thereby never reaching thermionic emission. Letting $P_{hc}$ be the heat input from the "hollow-cathode" like glow in the recess, and $P_{ss}$ be the time averaged heat input to the electrode during steady state operation, then $0.5P_{hc}>1.5P_{ss}$ ensures good thermionic take-over during starting with the more spatially distributed heating of the hollow-cathode like discharge in the recess. The factor of one half comes from the fact that the heating in the glow phase is only from the cathode ½-cycle in AC operation. This assumes the worst-case situation of not having condensed mercury on the electrodes to provide additional anode heating through the mercury vapor arc. To further constrain the electrode dimensions, the power flux of the hollow cathode discharge is defined to be $q_{hc}=P_{hc}/A_rN_s$ where $A_r$ is the area of the inner surfaces that bound the opening of slot (e.g. recess 60 in FIG. 3), not including the area of the slot or recess bottom, and Ns is the number of such slots. From experiments in 400 W slotted electrodes at a nominal fill gas pressure of 13.3 kPa (100 torr), the power flux qhc for each cathode ½-cycle (AC operation) from the hollow-cathode discharge is on the order of $q_{hc}$=2.5 kW/cm$^2$, increasing to about 4 kW/cm$^2$ at 20 kPa (150 torr). The corresponding lamp voltage is nearly the hollow cathode voltage $V_{hc}$ during starting and unlike the more common abnormal glow in discharge lamps, is relatively fixed over current. In these experiments, we also found that $300<V_{hc}<340$ V over the pressure range from 13–40 kPa (100–300 torr). In general, if we consider gases similar to argon in terms of ionization potentials and ion mobilities, such as xenon or krypton, and based on various literature studies, we would expect 200 V<$V_{hc}$<400 V at typical hollow cathode current densities of 1–10 A/cm$^2$.

From simulations of thoria-free electrodes in 150 W and 400 W HID lamp configurations operating at desirable (thoria-free) electrode temperatures of 2800 K–2900 K, typical steady-state powers for a given current I in A amps vary from roughly $P_{ss}$=3–10 W/A for AC (alternating-current) operation. Significantly higher values of heat input $P_{ss}$ would normally result in unacceptable losses into the electrodes for an efficient HID light source. Equations (2), (4*a*) and (4*b*) below indicate how to compute $P_{ss}$ approximately. Based on worst-case takeover requirements, $P_{ss}$=10 W/A for the average AC electrode heating power and the measured hollow-cathode power flux of 2.5 kW/cm$^2$ at 13.3 kPa. The condition for thermionic takeover on the active area $A_r$ of the recess and number of such slots $N_s$ satisfied for a given steady-state lamp current I is approximately:

$$N_s A_r / I > 0.012 \ (\mathrm{cm}^2/\mathrm{A}) \qquad \text{Equation 1c}$$

In the case of pure DC operation, hollow-cathode heating takes place continuously during the starting phase, thus effectively doubling the minimum heat input during starting. However, the upper limit to useful electrode heating during steady-state $P_{ss}$ is also larger because high transient cathode falls are eliminated as shown in Equations (8a) and (8b) below. Thus, Equation 1c is still a rough guide for AC and DC operation.

In the preferred embodiment of FIG. 3, recess area $A_r=0.5\pi(d_{12}-d_{22})$. FIG. 4 shows Table 1 listing the relevant dimensions and operating conditions for lamps with electrodes having standard forms and the general form (slotted) shown in FIG. 3. For the HQI slotted electrodes (sine-wave operation) in Table 1, the power loading area $N_sA_r/I$=0.016 cm$^2$/A. This requirement can be relaxed somewhat if the steady-state electrode heating power requirements are less than 10 W/A. Similarly DC starting phases or DC steady-state heat input with lower $P_{ss}$ less than 20 W/A also means a lower power loading area than in Equation (1c) may be used. Also this requirement is more stringent if average heating power requirements exceed 10 W/A (AC) or 20 W/A (DC).

A fourth requirement for proper starting and takeover into the thermionic arc is that the interior end 48 of the electrode, heat to thermionic emission in preference to any of the other region of the electrode. This means the most interior disk 58 of the electrode must not dissipate more power than is applied to that end through the recess discharge (hollow-cathode like discharge). Otherwise, the interior most disk 58 becomes a cooling surface for the electrode head and a higher temperature exists elsewhere on the head. To ensure that the interior-most disk 58 becomes thermionic in preference to all other disks, the input power to this disk must be greater than its thermally radiated power. Generally, other sources of loss at the tip 56 such as conduction through the gas are negligible. In the preferred embodiment FIG. 3, the ratio of the hollow-cathode heating applied to the tip 56 to the radiated portion is preferred to be greater than one:

$$0.5\frac{1-(d_2/d_1)^2}{(1+4h_1/d_1)}\frac{q_{in}}{\varepsilon\sigma_B T^4} \approx 7.5\frac{1-(d_2/d_1)^2}{(1+4h_1/d_1)} > 1 \qquad \text{Equation 1d}$$

Here, $\epsilon$=0.37 for the emissivity of tungsten head, $\sigma^B=5.67\times10^{-12}$ W cm$^{-2}$K$^{-4}$ is the Stefan Boltzmann constant, and the temperature T≈2900 K was chosen as a reasonable upper limit for a tungsten electrode tip temperature. The glow heat $q_{in}$ of approximately 2.5 kW/cm$^2$ is used. The experimental slotted electrodes in Table 1 satisfy this equation.

These constraints on recess and disk dimensions and rare-gas arc tube pressure, represented by Equations (1a) to (1d), comprise the preferred conditions for generating the high-current glow discharge within the recess and allowing a complete transition from glow to thermionic arc during the staring phase. The conditions distinguish in part the claimed invention from prior art. In particular, U.S. Pat. No. 3,303,377 Jansen; U.S. Pat. No. 6,437,509 Eggers; and U.S. Pat. No. 6,211,615 Altmann do not disclose hollow cathode like emissions from the interior disk recesses. The prior art only described cooling bodies.

While Equations 1a to 1d provide the preferred constraints for enhanced starting, electrode dimensions and material characteristics, and ballast waveform requirements may now be defined such that the electrode in FIG. 3 also has improved steady-state characteristics without the use of thoria. The electrode structure in FIG. 2 or FIG. 3 has considerable flexibility in thermal design. One can lower the tip temperature by using a large area tip 56 while almost independently controlling overall electrode thermal losses. Conducted thermal losses can be controlled through stem 48 and slot diameters such as 62. Limiting the radiating surface area and the surface temperature controls total radiated losses. The ability to control thermal losses independently of electrode tip area further distinguishes the claimed invention from the current art.

In general, specific lamp considerations may dictate electrode losses, cathode fall, and other electrode design parameters. However, the electrode structure in FIG. 3 achieves near optimal operating conditions only when certain constraints are met. While these constraints apply especially to emitter-free electrodes, their application to electrodes with emitters, including thoria, may yield improved maintenance, provided the temperature distributions and grain structure of the doped electrodes allow uniform and adequate transport of the emitter to the cathode surface.

For the electrode in FIG. 3 to support the desired lamp current through thermionic emission at lower steady-state tip temperatures, the area of the tip 56 must be large. This can be seen through the relation between total current density j, cathode fall $V_c$, and tip temperature T:

$$j = j_e(V_c, T)\left(1+\frac{V_c}{V_i}\right) \qquad \text{Equation 2}$$

Here, $j_e(V_c,T)$ is the electron current density (A/cm$^2$) produced by thermionic emission as a function of cathode fall and temperature. The temperature dependence of the current density is well known and has a strong positive exponential dependence. The dependence on cathode fall $V_c$ comes from the electric field enhancement of thermionic emission (Schottky effect). The exact relation between the local electric field and cathode fall depends on whether the sheath is collisional or collisionless and in turn on the operating pressure of the lamp. In general, the temperature dependence of cathode fall $V_c$ is considerably weaker than explicit temperature dependence of thermionic emission. Details on the relation between cathode fall and the local electric field at the electrode surface can be found in literature discussions. For a given cathode current I and attachment area $A_a$, the current density is, $$j = \frac{I}{A_a} \quad \text{Equation 3}$$

Since the cathode attachment occurs where electrode surfaces provide most of the total thermionic emission current, the attachment area $A_a$ consists of surfaces within about 100–200 K of the hottest regions of the electrode. Thus the attachment area $A_a$ includes the tip and surrounding hot surfaces. In the embodiment shown in FIG. 3, this is primarily the interior surface of tip 56 and the side surface of the most interior disk, distance 58 in FIG. 3.

Equation 2 shows that the tip temperature decreases with a decreasing current density and a fixed cathode fall. Since the evaporation rate depends exponentially with temperature, a small reduction in tip temperature, even with increased evaporating area, tends to decrease the overall amount of wall blackening in the lamp during steady-state operation. Thus one might be able to decrease wall blackening by increasing the area of the tip and surrounding surfaces, provided the cathode fall can be controlled. The recess 60 further increases the attachment area $A_a$ and traps some of the evaporating electrode material Heating of these surfaces is accomplished from energy gained by ions in the cathode sheath and electrons captured in the anode phase. In the case of DC operation where the electrode is always in the cathode phase with current $I_{dc}$, the total average heat input during steady state operation is:

$$P_{ss} \cong I_{dc}(V_c - \phi_w) \quad \text{Equation 4a}$$

where $\phi_w$ is the (Schottky-reduced) work function of the electrode. In the case of an AC waveform with current $I_{ac}$ that is symmetric in both positive and negative half-cycles, and the total cycle average heat input $P_{ss}$(W) to the electrode is given approximately by the following equation:

$$P_{ss} \cong \frac{|\bar{I}_{ac}|}{2}(\phi_w + \varphi_e) + \frac{|\bar{I}_{ac}|}{2}(\bar{V}_c - \phi_w) \cong \frac{|\bar{I}_{ac}|}{2}(\bar{V}_c - \varphi_e) \quad \text{Equation 4b}$$

The overbar indicates the rms average over the respective half-cycles. The quantity $\phi_e$ is the electron enthalpy and is approximately 2.5 $T_e$, where $T_e \approx 0.5$–1 eV is the electron temperature of the plasma near the cathode. The first term in Equation (4b) represents average anode phase heating and the second represents the average cathode phase heating. It is assumed in Equation (4b) that the operation frequency is much faster than the gross thermal response of the electrode structure. For practical HID electrodes up to 400 W, waveform frequencies above 30 Hz are clearly in the AC regime. For operation by a ballast that provides a steady-state peak lamp current of $I_p$ and peak cathode fall voltage $V_p$, the rms values can be related to the peak values by a different waveform factors f typically used to describe power in electrical waveforms. For the special cases of square-wave and sine-wave ballast current waveforms, $$f = 1, \text{(square-wave)}$$

$$f = \sqrt{2}, \text{(sine-wave)} \quad \text{Equation 5a}$$

with the rms values given by, $$\bar{I}_{ac} = I_p/f$$

$$\bar{V}_c = V_p/f \quad \text{Equation 5b}$$

The heat input to the electrode head is then balanced by the average total radiated losses and conducted losses down the stem to the thermal sink at the seal area. To provide typical thermionic driven current densities of 0.1 to 10 A/mm$^2$ with undoped (no emitters) cathodes, Equation 2 requires tip temperatures in the range of 2500 to 3000 K. The actual temperature depends on current density and weakly on the ionization energy of the metal-halide vapor, vapor composition, operating pressure, and related details of the near electrode plasma. The cathode fall in Equation 4a or 4b adjusts to provide the needed energy balance $P_{ss}$ (heat input) at the required tip temperature. Thus electrodes with large thermal losses have higher cathode falls for a given current than electrodes with lower losses. To express these ideas for an arbitrary electrode consisting of a stem followed by a number of larger disks of different diameters, each axial segment of the electrode in FIG. 3 may be numbered, starting with the innermost disk (48 in FIG. 3) and numbering toward the stem k=1, 2, . . . N, where N is the total number of segments including the stem. The disk labeled k=1 is the interior-most disk and is in direct contact with the arc. The heat balance can be expressed by the following relations for DC and AC operation respectively:

$$P_{ss} \cong (V_c - \phi_w)\bar{I}_{dc} = \frac{T - T_0}{\theta} \quad \text{Equation 6a-DC cathode}$$

$$P_{ss} \cong \frac{1}{2}(\bar{V}_c - \varphi_e)\bar{I}_{ac} = \frac{\bar{T} - T_0}{\theta} \quad \text{Equation 6b-AC}$$

The quantity θ in Equation (6) is the effective axial thermal resistance of the electrode structure (at operating temperatures). An exact form of θ includes radiation losses and therefore depends on the temperature distribution along the axial surfaces of the electrode. Approximating each disk and stem as a structure having fixed thermal conductivity $\kappa_k$, cross-sectional area $A_k$, and thickness (or length in the case of the stem) $h_k$, gives the following expression for θ:

$$\theta = \sum_{k=1}^{N} \frac{h_k}{\kappa_k A_k}(1 - \alpha_k) \quad \text{Equation 7}$$

The coefficient $\alpha_k$ is the fraction of total radiated power from the electrode surface over the region from the tip (segment 1) to the middle of the disk (or stem) k. When k=N, $\alpha_N$ is the total radiated loss from the entire electrode. $A_N$ and $k_N$ refer to the cross sectional area and thermal conductivity of the stem respectfully for the electrode in FIG. 3. Note that $d_N = d_s$ and $h_N = h_s$ as well In practice, first order estimates of the temperature distribution can be used to determine radiation losses. Simulations with tip temperatures at around 2800 K typically show about 30 percent to 40 percent of the total input power to the electrode is lost through thermal radiation, mostly on sections of the electrode that are above 2500 K. This corresponds to $\alpha_N$=0.3–0.4. In practice the solution of the tip temperature given by Equations (2), (3), (6) and (7) must be solved numerically.

These results show why a rod structure and even rods with coils (as commonly used in HID lamps) cannot achieve optimal steady-state temperatures. For a rod, the thermal resistance is (with radiation losses)

$$\theta = \frac{h_1}{\kappa_1 A_1}(1-\alpha_1),$$

(N=1). Substituting the rod result into the energy balance Equation (6) shows that increasing the diameter to lower current density and therefore tip temperature has the problem of increasing the required heating power $P_{ss}$. When coils are used at the tip, coil wire diameter usually scales with rod diameter to maintain reasonable thermal and mechanical integrity. Therefore even the coiled design has increased heating power with increasing tip surface area in practice. On the other hand, the including a head 30 (FIG. 2) allows one to independently increase tip area and therefore reduce steady-state tip temperature without increasing the required heating power to the tip. For the embodiment in FIG. 3, this is accomplished by making the stem diameter $d_s$ smaller than the tip diameter $d_h$. By incorporating hollow cathode like discharge generating recesses, the tip area can be increased further without inhibiting starting. Equation 7 also shows that increasing the slot depth ($d_1$–$d_2$) to improve the hollow-cathode starting is not detrimental to steady-state performance. The increased thermal resistance of the deep slot is compensated by increasing the stem diameter $d_s$ slightly or decreasing the stem length $h_s$.

The flexible design in FIG. 3 allows a degree of optimization of steady-state electrode performance over conventional electrode designs while meeting the conditions for a hollow cathode discharge during starting. The underlying concept is to increase tip area while adjusting the overall thermal resistance of the electrode to provide a reasonable cathode fall. Since a high cathode fall increases the amount of current carried by ions in the sheath, the needed fraction of current carried by thermionic electrons decrease. As a result, a higher cathode fall in Equation (2) reduces the tip temperature. The higher cathode fall is achieved by requiring the sheath to supply more heating power to the electrode as shown in Equation (4). However, excessive cathode falls may be undesirable for several reasons. First, it is well known that large instantaneous cathode falls lead can lead to sputtering, causing wall blackening in spite of lower tip temperatures. Typical sputtering thresholds are approximately 50 V and depend on ion type, electrode material, and electrode temperature. In practice, since high-temperature sputtering near threshold has not been well investigated, one should limit peak cathode falls to 20 V to 30 V. Furthermore, the increased heating power to the electrode reduces lamp efficiency by draining electrical power from the light-emitting plasma of the lamp and redirecting it into the electrodes. These electrode heating losses are particularly important for mercury free lamps that typically run at higher currents than mercury-containing lamps for a given lamp power. Based on the desired cathode fall ranges, Equations (4a), (4b), (5a) and (15b) imply approximate upper limits for electrode input power per applied rms current $L_e$ given by, $$L_e < 25 \text{ W/A} \qquad \text{Equation 8a—DC cathode}$$

$$L_e < 12 \text{ W/A} \qquad \text{Equation 8b—AC}$$

Equations 8a and 8b are preferred guidelines for HID lamps, but are not essential to the operation of the electrode. In general, one may want to use $L_e$<10 W/A (AC) or $L_e$<20 W/A (DC) to aid worst-case take-over from the recess discharge (hollow-cathode) glow phase.

Given the desired cathode fall, or equivalently the desired electrode heat input in Equations (8a) and (8b), theoretical results may be used to determine further constraints on the electrode design such that the arc attachment remains in diffuse mode. The preference is that the total heat flux to the tip in W/cm$^2$ should not exceed a critical value, given a material work function and tip diameter; otherwise small temperature or heat flux variations on the tip surface can become amplified by the sheath and the diffuse arc attachment can become unstable. The resulting arc attachment then constricts into much hotter spot arc attachment that generally exists at much higher temperatures, causing excessive electrode material evaporation. In the case of electrodes containing non-thoria emitters, emitter material also evaporates in the spot mode. Thoria emitters appear unique, having one of the lowest vapor pressures of the available tungsten emitters and can provide good maintenance with spot attachment. However, one object of the recess generating emission structure is to remove thoria because of its undesirable environmental properties.

To design thoria-free electrodes for the more desirable diffuse arc attachment, conditions on the electrode must be met to ensure stable diffuse arc attachment. The analysis is formulated by examining the time-dependent perturbations of the boundary layer heat flux from the cathode sheath and the resulting conducted heat distribution in the electrode tip. Similar treatments exist in the literature. The fundamental result for a cylindrical surface with electrically and thermally insulating sides is that the desired diffuse mode remains stable to small perturbations when, $$\frac{d_1}{2\kappa_1}\frac{\partial q}{\partial T} < \beta_{10} \qquad \text{Equation 9}$$

Here, $\kappa_l$ is the thermal conductivity of the electrode material at the tip of diameter $d_1$, where k=1 is the interior most disk. The derivative $\partial q/\partial T$ is the partial derivative of the net heat flux (W/cm$^2$) into the electrode tip and includes the ion heating from the sheath region, electron cooling, and radiative cooling from the electrode surface. The partial derivative $\partial q/\partial T$ is evaluated at constant sheath voltage and at tip temperature T. The coefficient $\beta_{10}$=1.8412 is the second zero of the derivative of the integer order Bessel functions, $J_m'(\beta_{mn})=0$. It is important to note the result of Equation (9) does not incorporate effects such as evaporation of dopants and non-uniform emitter material distributions on the electrode surface. As a consequence, arc attachment on electrodes with emitters requires additional experimentation.

To roughly account for thermionic emission from the sides of the electrodes in FIG. 3 (or FIG. 2) the heating on the sides is assumed to contribute to the amplification (and instability) of a perturbation near the tip. The ratio of the attachment area $A_a$ and tip area $A_1$ is defined to be an overfilling factor η:

$$\eta = \frac{A_a}{A_1} \qquad \text{Equation 10}$$

Generally this overfilling factor ranges from 2<η<3 on cylindrical tips. Using the results of Equations (2) and (6), the diffuse stability condition can then be expressed as:

$$K_{stab} \equiv \frac{2}{\pi d_1 \kappa_1 \theta}\left(\frac{\gamma}{\eta}\right)\left(1-\frac{T_0}{T}\right)\delta < \beta_{10} \quad \text{Equation 11a-DC}$$

$$K_{stab} \equiv \frac{4f}{\pi d_1 \kappa_1 \theta}\left(\frac{f\overline{V}_c - \phi_w}{\overline{V}_c + \varphi_e}\right)\left(\frac{\gamma}{\eta}\right)\left(1-\frac{T_0}{T}\right)\delta < \beta_{10} \quad \text{Equation 11b-AC}$$

The correction $\gamma$ is an additional factor that accounts for heating of the sides of the electrode that contribute to the instability. In general, the correction factor is less than the overfilling factor $1<\gamma<\eta$. The amplification coefficient $\delta$ is a factor that comes from evaluating the partial derivative $\partial q/\partial T$, assuming the electrons are produced by thermionic emission. This is found to be approximately, $$\delta \cong 2 + \frac{\phi_w}{kT}, \quad \text{Equation 12}$$

where $\phi_w$ is the Schottky-corrected work function of the electrode tip material. The smaller effects of the temperature dependence of the Schottky correction and radiative cooling have been neglected. Both effects decrease stability coefficient $\delta$, making the diffuse attachment more stable. For a tungsten electrode without emitter materials, the coefficient $\delta$ is approximately 20.

Equations (11a) and (11b) together with equation 7 show several unexpected features of the diffuse mode attachment when the geometry of FIG. 3 is used. The most important feature of the electrode in FIG. 3 one can maintain the diffuse mode ($K_{stab}<\beta_{10}$) with increasing tip diameter. This is accomplished by keeping the ratio of the stem diameter squared to tip diameter fixed.

$$\frac{d_N^2}{d_1} \approx \text{constant} \quad \text{Equation 13}$$

That is $$\frac{d_N^2}{d_1}$$

is approximately constant to scale the electrode in FIG. 3. This keeps the product of overall thermal resistance and $\theta$ roughly fixed. Arc attachment on conventional electrodes generally becomes more unstable with increasing tip diameter because the stem and tip are formed from a single rod. Thus the thermal resistance $\theta$ decreases by roughly $1/d_N^2$ in Equations (11a) and (11b). Therefore, at least when no emitters are used, better maintenance can be achieved using an electrode with a discharge generating recess compared to conventional rod-based electrodes. This is because the discharge generating recesses allow electrodes with large tips to have diffuse attachment and start well. Additionally, the recesses are found theoretically and experimentally to further improve diffuse mode stability (lower $K_{stab}$) as described below.

A second feature of Equations (11a) and (11b) is that stability is somewhat ballast-dependent. The dependence of stability on ballast waveforms in the preferred embodiment, from most stable to least stable, is: DC>AC square-wave>AC sine wave. Therefore for a given set of design constraints, one may be able to achieve stable attachment with lower thermal resistances for square-wave than for sine wave and gain further improvements in maintenance. Physically, this is expected because the more dynamic the waveform, the more cooling and heating the electrode undergoes in a full waveform cycle. This induces larger excursions in the cathode fall and therefore a higher degree of instantaneous peak heat flux that causes instabilities as shown in Equation (9). A third feature of the stability result (Equation 11) is that raising the thermal conductivity of the tip $\kappa_1$ with respect to other sections of the electrode, especially those with high thermal resistance, also improves diffuse mode stability. High thermal conductivity in the tip region helps increase heat flow away from any temperature perturbation that the sheath would otherwise amplify.

In general, the best maintenance is be achieved when other design criterion such as ballast waveforms, physical size limits in the lamp, sputtering, and losses to the electrodes allow the tip to be made as large as possible and thermal resistance as low as possible to achieve higher cathode falls with peaks less than 20 to 30 V.

As a minimum requirement, Equations (11a) and (11b) show that product of the stem diameter and stem thermal conduction should be less than the tip diameter and tip thermal conduction to take advantage of the improved maintenance of the electrode with a discharge generating recess along with the hollow-cathode criteria (Equations 1a–1d):

$$\kappa_1 d_1 > \kappa_N d_N \quad \text{Equation 14}$$

Experiments were performed to verify the main features of the preferred embodiment of FIG. 3. Electrodes in Table 1 (FIG. 4) were fabricated using the grinding techniques described previously. For comparison, dimensions of solid (non-thoriated), coiled (non-thoriated), and coiled (thoriated) control electrodes are shown as well. Electrodes were fabricated for quartz (HQI) and ceramic (HCI) arc tubes.

To test the effect of the electrode with a glow discharge recess on the glow-to-arc transition, the recessed HCI electrode in Table 1 (FIG. 4) was compared to two different control electrodes. The first control was a standard electrode consisting of a 0.75 millimeter diameter potassium-doped tungsten rod (about 60 to 70 parts per million of by weight) with a 5-turn single layer coil, having a 0.26 millimeter wire diameter. The coil is at the tip and participates in thermionic emission during starting and steady state. The second control was a solid tip electrode identical in shape, material, and dimensions to the HCI recessed electrode in Table 1, but formed without a recess. The electrode without a recess has the advantage of larger surface area but without structures to produce a hollow cathode discharge during the starting phase. All lamps were filled with 25 milligrams rare-earth iodide salts, 42 milligrams of mercury, and 13.3 kPa (100 torr) argon starting gas. The corresponding Sp ($h_2p$) for the slotted electrodes was 370 Pascals-centimeters (3 Torr-cm). The ceramic arc tubes were 400-watt ceramic ball type envelopes (OSRAM PowerBall™) designs with an arc gap of approximately 20 millimeters. The lamps were operated on a standard regulated lag type M-135 magnetic ballast.

Table 2 (FIG. 7) shows the results. The recessed (slotted) electrodes had an average glow to arc time of 0.3 seconds, a 60 percent improvement over standard solid electrodes, and a 20 percent improvement over standard coil tipped electrodes. The energy deposition showed similar behavior, indicating the positive effect of the hollow cathode discharge between the adjacent disks. The recessed (slotted) electrodes had an average glow to arc energy input of 39.8 Joules, 41 percent of the energy required by standard solid electrodes, and an 84 percent of the energy required by standard coil tipped electrodes. The results show the large improvement in glow-to-arc behavior with the addition of the slotted structure.

In an alternative embodiment, the lamp for an HQI electrode consisted of a 400 W quartz arc tube filled with 20.7 milligrams NaI, 3.1 milligrams of $ScI_3$, and 52.9 milligrams mercury and an argon pressure of 4100 Pascals (31 torr). The corresponding Sp ($h_2p$) was 120 Pascal-cm (0.9 torr-cm).

Figure 8:
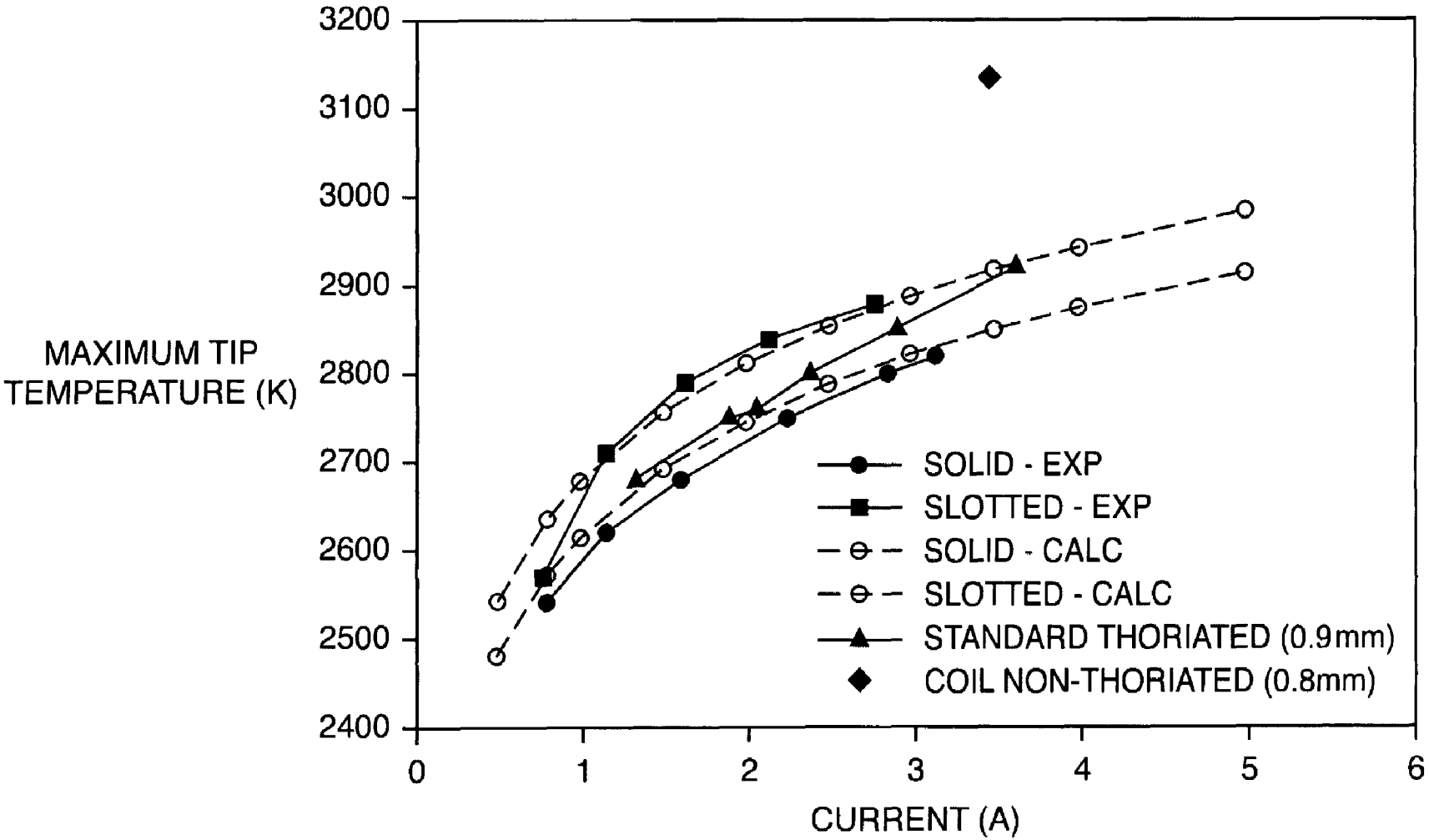
FIG. 8 shows a chart of electrode tip temperatures measurements by current for differing electrode types.

To show that the head shaped design with discharge generating recesses reduce electrode temperatures and therefore improve steady-state maintenance, electrode temperature distributions were measured using infrared imaging. FIG. 8 shows a chart of the maximum side-on electrode tip temperature as a function of current for the HQI electrode in Table 1 and three control cases. The first control was identical to the HQI recessed electrode, but without a recess (solid). The second control electrode was a thoriated 0.9 millimeter diameter rod of insertion length 8.5 millimeters and a (non-thoriated) coil approximately 2.8 millimeters from the tip. The third control electrode was a non-thoriated, potassium-doped 0.8 millimeter diameter rod with a non-thoriated coil, approximately 2.8 millimeter from the tip and an overall insertion length of 8.5 millimeter. All electrodes were mounted in 400-Watt quartz arc tubes. For these measurements, lamps were operated on electronic square wave ballast. The large tip extension of these typical rod and coil electrodes causes them to function like pure rod electrodes during steady state.

The results show that the recessed electrode at the design current of 3.5 Amps, has the same tip temperature as the thoriated coiled electrode. This is achieved without any emitter material to reduce the work function. The recessed head electrode has a tip temperature that is also 200 Kelvin lower than the tip temperature for a 0.8 millimeter non-thoriated coiled electrode. This demonstrates that using a large area tip can reduce tip temperature significantly over typical rod designs. A pure rod with a diameter of 1.5 millimeters would have unacceptably high heat input requirements and would be expected to run in spot mode. The solid tip electrode has even a lower temperature than the slotted electrode, but has the poor starting characteristics noted in Table 2. Thus, the data in Table 2 (FIG. 7) show that the thoria-free (no emitter) electrode in FIG. 4 has starting and steady state characteristics that are as good as a standard thoriated electrode. The results in FIG. 8 also show 2D boundary layer calculations for the recessed and solid tip electrode that are in very close agreement with measurements. In all cases, the attachment mode was diffuse for these measurements.

In addition to the recessed structure providing both desirable starting and steady-state characteristics, the recessed electrode structure further improves the stability of the diffuse attachment when compared to an equivalent solid tip electrode. Improved arc stability can also lead to improved maintenance during dimming since the lower currents tend to result in spot operation. Experiments were performed to test the stability of the recessed electrode. By monitoring voltage waveforms on the M-135 ballast for the lamps in Table 2, voltage discontinuities on the microsecond time scale can be observed that signify a diffuse to spot transition on the cathode. In steady state, the transformer saturation characteristics of this ballast tend to operate lamps with a low lamp power factor and can induce transitions to spot mode. For vertically running lamps, the recessed lamp underwent a diffuse to spot transition at a current of 1.8 amps rms for one electrode and 2.6 amps rms for the other electrode. This compares to a threshold of 3.2 amps rms for the solid tip for both electrodes. The standard coiled electrode was still best in this respect showing a transition only for one electrode (one phase of the waveform) at 1.8 amps rms. However, the standard electrode without thoria does not have the improved maintenance of the recessed type.

Estimates of diffuse mode stability ($K_{stab}$) for the electrodes used in these embodiments are shown in Table 1. For these simple estimates, the correction factor $\gamma$ is taken to be one, and the diffuse mode condition is satisfied by roughly a factor 1.5 to 3 for these electrodes. The overfilling factor $\eta$ was taken to be 3 with sine wave or square-wave excitation assumed. The approximation for the term $(f\nabla_c-\phi_w)/(\nabla_c+\phi_e)\approx f$ was made. The coiled electrodes were more difficult to evaluate with simple approximations because of the complicated heat transfer between coil and rod. For these estimates, the coil was simply replaced by an effective solid cylinder.

The estimates predict that the electrodes in HQI lamps are less stable (larger $K_{stab}$) than the ceramic because of the lower reference temperature $T_0$ and shorter effective lengths in the HQI case. In the HQI arc tubes the reference temperature is the seal temperature while for the HCI, the reference temperature is where electrodes are welded to additional feed through components before making intimate thermal contact with the capillary body. The slotted electrodes have a slightly lower stability factor and therefore should exhibit slightly better stability characteristics. This agrees with observations of the HCI electrodes on the sine-wave ballast. Also Table 1 shows that square-wave should be more stable than sine wave, in qualitative agreement with the temperature measurements made on a square-wave ballast.

To test the steady-state performance of the recessed electrodes continuous life tests were performed on the slotted thoria-free HQI-T 400 W lamps with $d_h$=1.5 mm and the thoriated control HQI lamp in Table 1. All lamps were burned in the horizontal orientation. HQI lamps with slotted thoria-free electrodes with head diameters $d_h$=1.1 and 1.3 mm were also tested. To investigate the effect of the slots, identical HQI lamps with solid electrodes having the same dimensions as the slotted were additionally tested. All lamps were tested on 50 Hz choke ballasts operating at a nominal current of 3.5 A. After 1500 hours of operation, the following results on arc attachment were observed: All thoriated electrodes were found to run in spot mode attachment as often observed. Nearly all the solid thoria-free electrodes ran in a spot-mode or somewhat constricted arc attachment. All of the slotted (recessed) thoria-free electrodes ran in diffuse mode, consistent with previous observations of HCI lamps. The only exception was some x-ray evidence of asymmetrical evaporation on one of the $d_h$=1.5 mm electrode surfaces that did not appear related to the horizontal burning position. Photometric and electrical parameters were measured at 0, 100, 500, 1000, and 1500 hours for these lamps. The results at 1500 hours can be summarized as follows: The lamps with slotted (recessed) electrodes showed a mean luminous flux (lumen maintenance) relative to 100 hours of 95 percent for the dh=1.1 and 1.3 mm electrodes and 90 percent for the $d_h$=1.5 mm electrode. These results were as good or better than the thoriated control lamps, which had a lumen maintenance of 85–90 percent. The best solid head results ($d_h$=1.1 mm) showed less than 70 percent lumen maintenance most likely from the spot-mode attachment. The lamps with slotted electrodes showed no voltage rise and only modest evaporation from the tip edges (from x-rays). In fact the voltage decreased by 5–8 V over this time span. The control lamps and the solid electrode showed a slight to moderate voltage rise of 5–10 V and showed moderate amounts of evaporation from the spot attachment at the tip. Thus, the life test data confirm that the embodiment in FIG. 3 for thoria-free electrodes with recesses can provide at least as good maintenance as thoriated electrodes with coils with a non rare-earth fill. The data demonstrate the advantage of the recesses in controlling diffuse-mode attachment. Many of the concepts described can be applied to other embodiments of the electrode with a discharge generating recess. In a second embodiment of the recessed electrode, the stem and tip sections are made of different refractory materials, whereby the stem is made from a refractory material with a thermal conductivity $\kappa_N$ less than the thermal conductivity of the recessed tip section $\kappa_1$.

Figure 9:
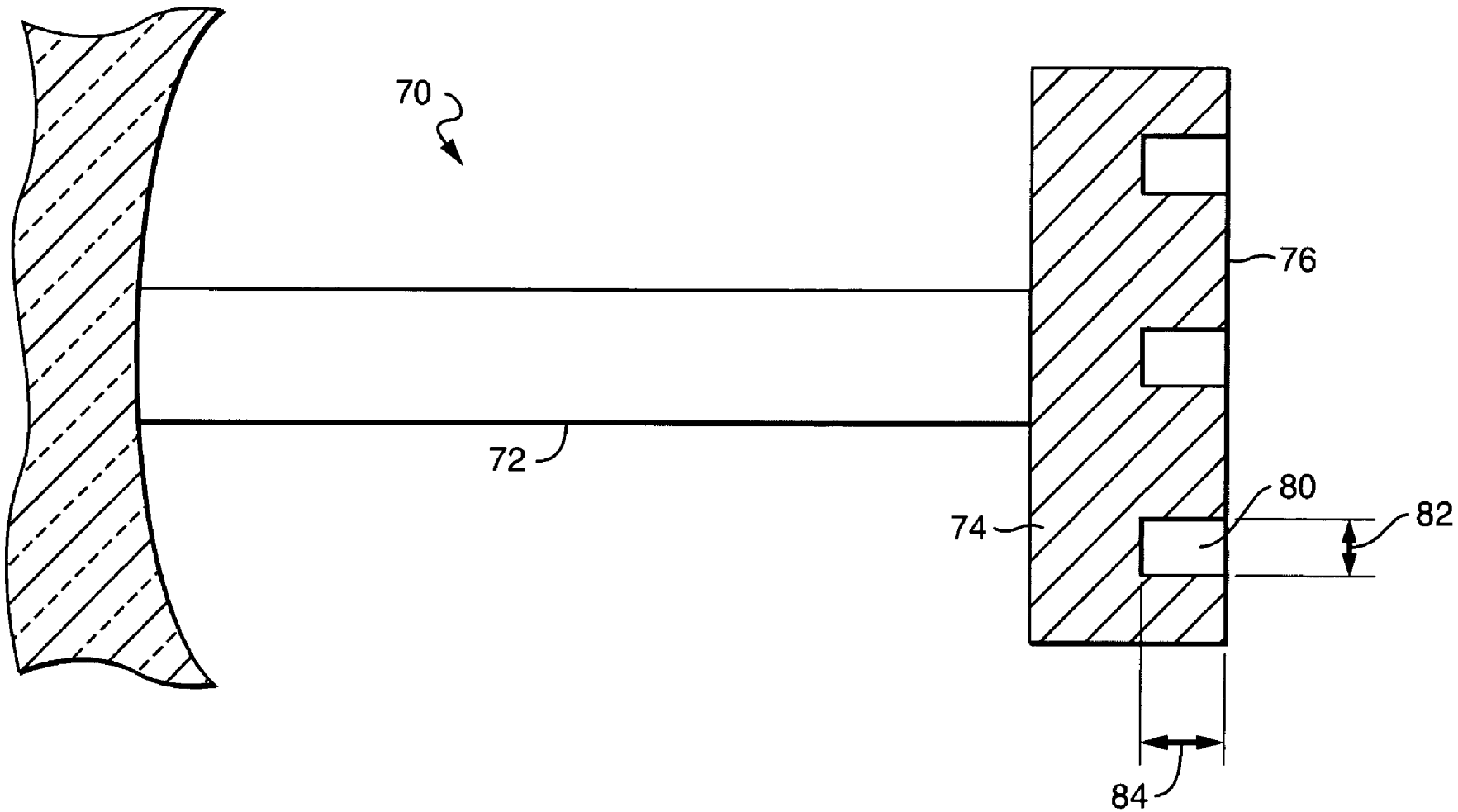
FIG. 9 shows a cross-sectional view, partially broken away, of an alternatively preferred electrode head with shaft recesses formed on the front face of the electrode head.

In a third embodiment, shown in FIG. 9, the recesses are replaced by one or more hollow regions on the top of the tip body to achieve a similar hollow cathode effect. Mechanical or laser drilling can form the hollow regions. The hollow regions must satisfy the requirements for a hollow cathode discharge during starting. In the case of argon buffer gas, the diameter of the hollow $d_h$ and depth of the hollow $l_h$ must satisfy the conditions, $$70<d_h p<1200 \text{ Pa-cm} \qquad \text{Equation 6a}$$

The recess depth D must be large enough to contain sputtered tungsten within the recess and to provide enough current:

$$D>d_g. \qquad \text{Equation 6b}$$

Figure 10:
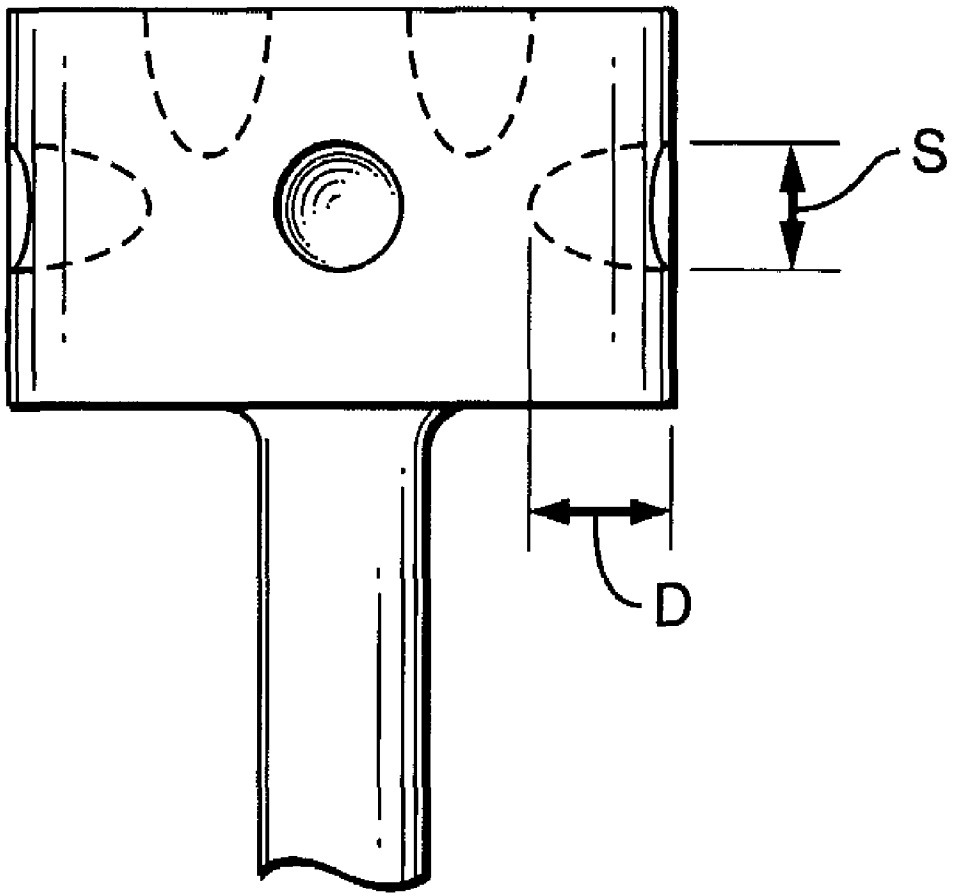
FIG. 10 shows a side view of an electrode with bore type recesses.

In a fourth embodiment shown in FIG. 10, such hollow recess regions can be on the front side of the tip body, either alone or with hollow regions on the top of the tip body. The electrode 70 may be formed as a solid body with an inner stem 72 supporting a head 74 at the innermost end of the electrode 70. The head 74 may include a flat end face 76. Formed in face 76 may be one or more recesses such as a hole, slot, slit or groove. The recess may be an axially extending bore 80. Bore 80 has a least spanning distance (diameter) 82 and a depth 84. The diameter 82 is greater than the maximum electron ionization mean free path but less than twice the minimum cathode fall plus one negative glow distance, throughout the glow discharge phase of starting and for the chosen fill gas composition and pressure. The depth 84 is preferably greater than the spanning distance 82. It is understood there may be a plurality of such bores on the front face 76, and that grooves, slots, and similar openings may be used where they comply with the size and shape specification.

Figure 11:
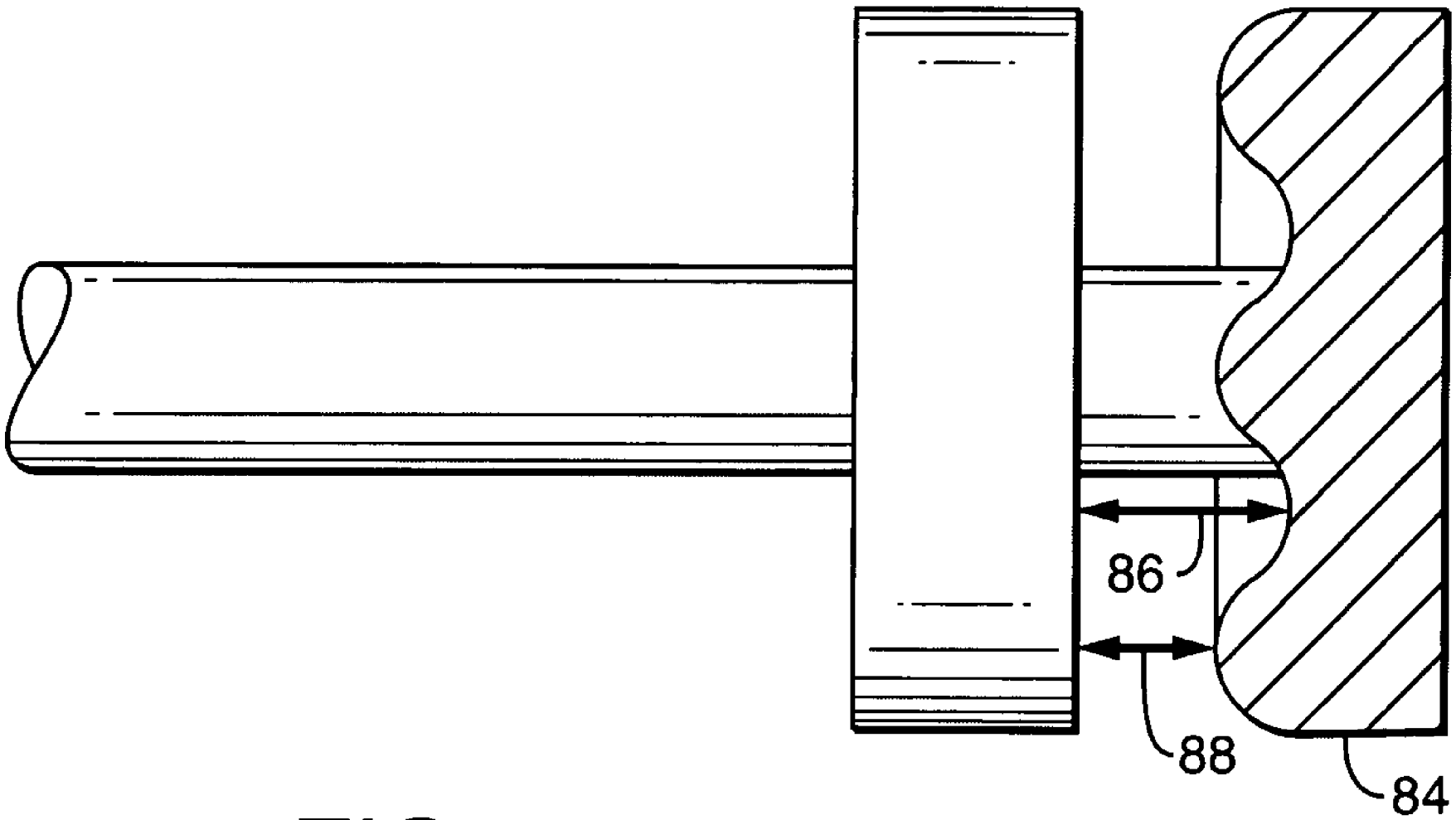
FIG. 11 shows a side view, partially broken away, of an alternatively preferred electrode head with variable recess spanning dimensions.

In a fifth embodiment, FIG. 11 the parallel grooves in the preferred embodiment in FIG. 3 are replaced by grooves consisting of flat non-parallel or curved surfaces such that the distance between the surfaces, where the hollow-cathode glow forms, is variable. Thus the SP is different for each part of the groove, allowing a greater range of pressures to produce a hollow-cathode effect. This may be helpful during starting where the gas rarification from electrode heating causes large variations in gas density. Thus such a design allows a hollow-cathode discharge to form optimally within a certain region of the grooves during the start-up phase.

Figure 12:
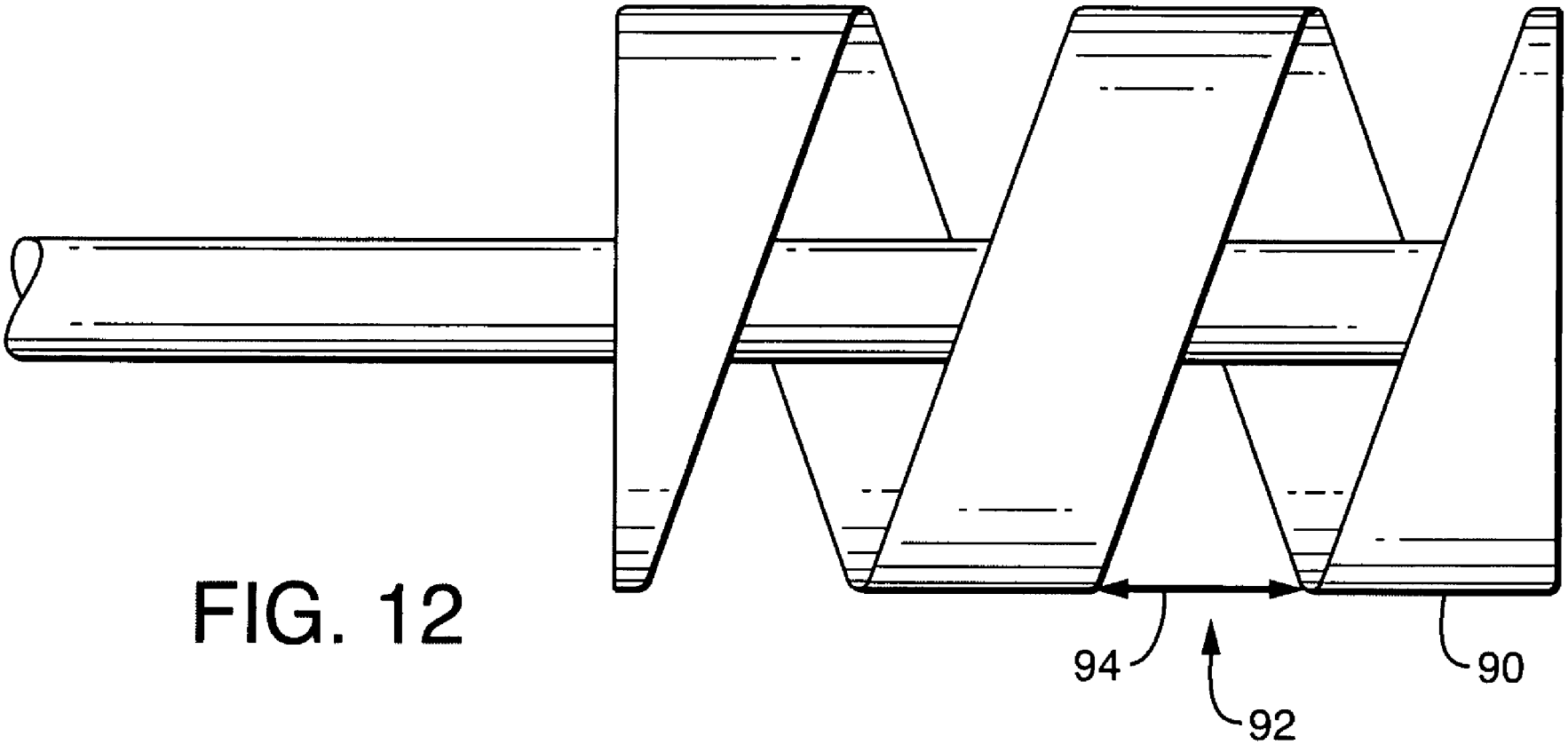
FIG. 12 shows a side view, partially broken away, of an alternatively preferred electrode head with a spiral recess.
Figure 13:
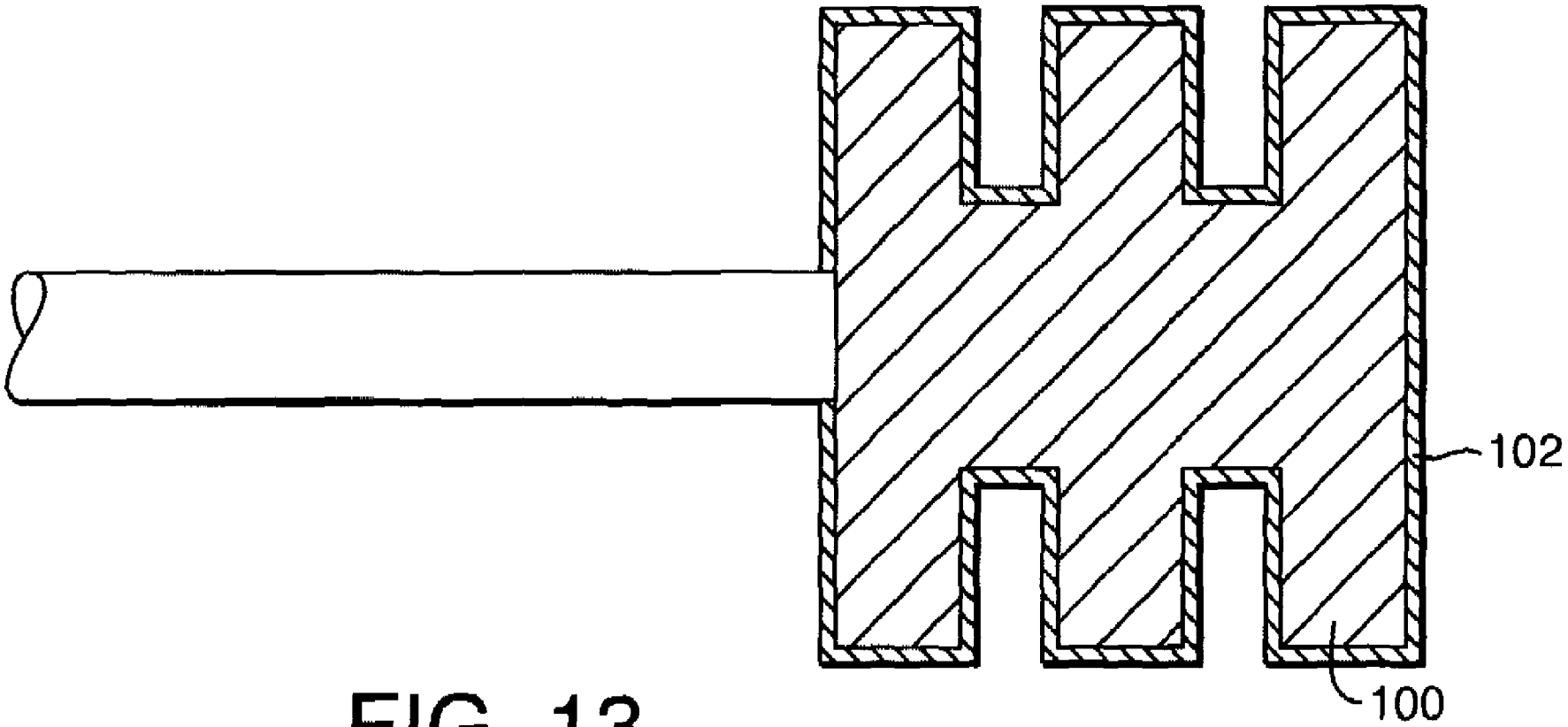
FIG. 13 shows a cross-sectional view, partially broken away, of an alternatively preferred electrode head with an emitter coating.

The recess may have a variety of alternative forms. It may be a bore like opening as in FIG. 2, or a groove as in FIG. 3. FIG. 10 shows a cross-sectional view, partially broken away, of an alternatively preferred electrode head 76 with bore recesses 80 formed on the front face of the electrode head. The recess span 82 and the recess depth 84 otherwise conform to the above description. The spanning dimension may be variable so that as the lamp ages, or due to variations in manufacture, there is still an optimal spanning dimension for the actual lamp conditions. FIG. 11 shows a side view, partially broken away, of an alternatively preferred electrode head with variable recess spanning dimensions. The lead disk 84 is formed with a sinusoidal face, but a geared like or similar wavering face provide differing spanning dimensions such as 86 and 88 with respect to the opposed surface of across the recess. FIG. 12 shows a side view, partially broken away, of an alternatively preferred electrode head 90 with a spiral recess 92. The recessed groove need not be circular, but may be helical allowing attachment to flow more easily in the axial dimension. The spanning dimension 92, still complies with the above conditions. FIG. 13 shows a cross-sectional view, partially broken away, of an alternatively preferred electrode head 100 with an emitter coating 102. The electrode in any of the various embodiments may be doped with an oxide emitter material. FIG. 13 shows an electrode stem and head 100 dip coated in an emitter material leaving a coating layer 102. Emitter coatings that may be used include such well-known high-temperature emitter dopants as $ThO_2$, $La_2O_3$, $HfO_2$, $CeO_2$, and related oxides. The emitter material can be incorporated directly into the electrode as is commonly done in thoriated electrodes. By virtue of the lower work function of such doped electrodes, the tip temperature can be reduced below temperatures at which evaporation of the emitter material is insignificant, providing monolayer coverage on the surface over the life-expectancy of the lamp. The low temperature of the doped electrode is achieved again by using one of the first five embodiments to provide a large tip area while having acceptable electrode heat inputs and cathode fall.

Figure 14:
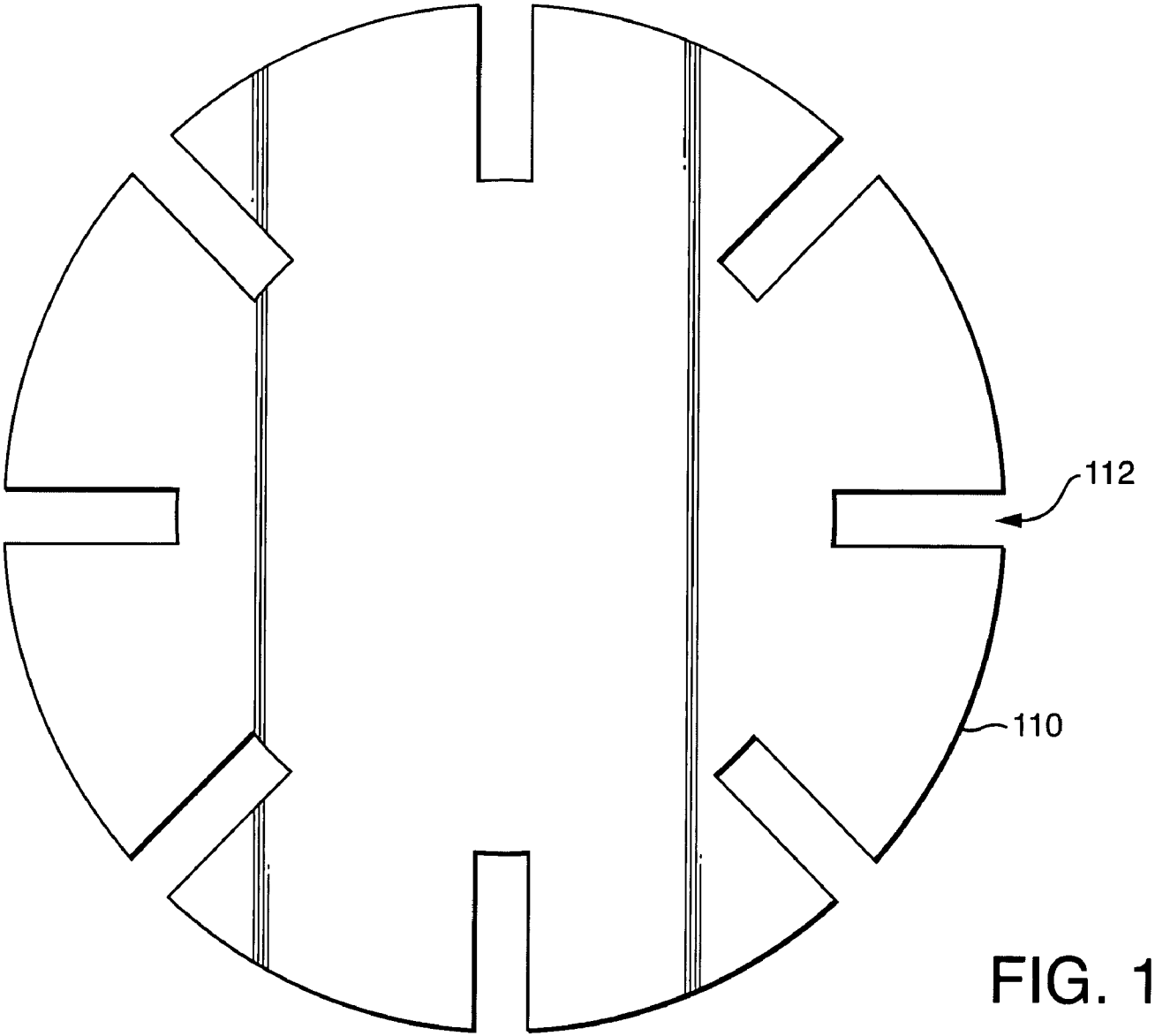
FIG. 14 shows a front end view of an electrode head with an axial recess groove.
Figure 15:
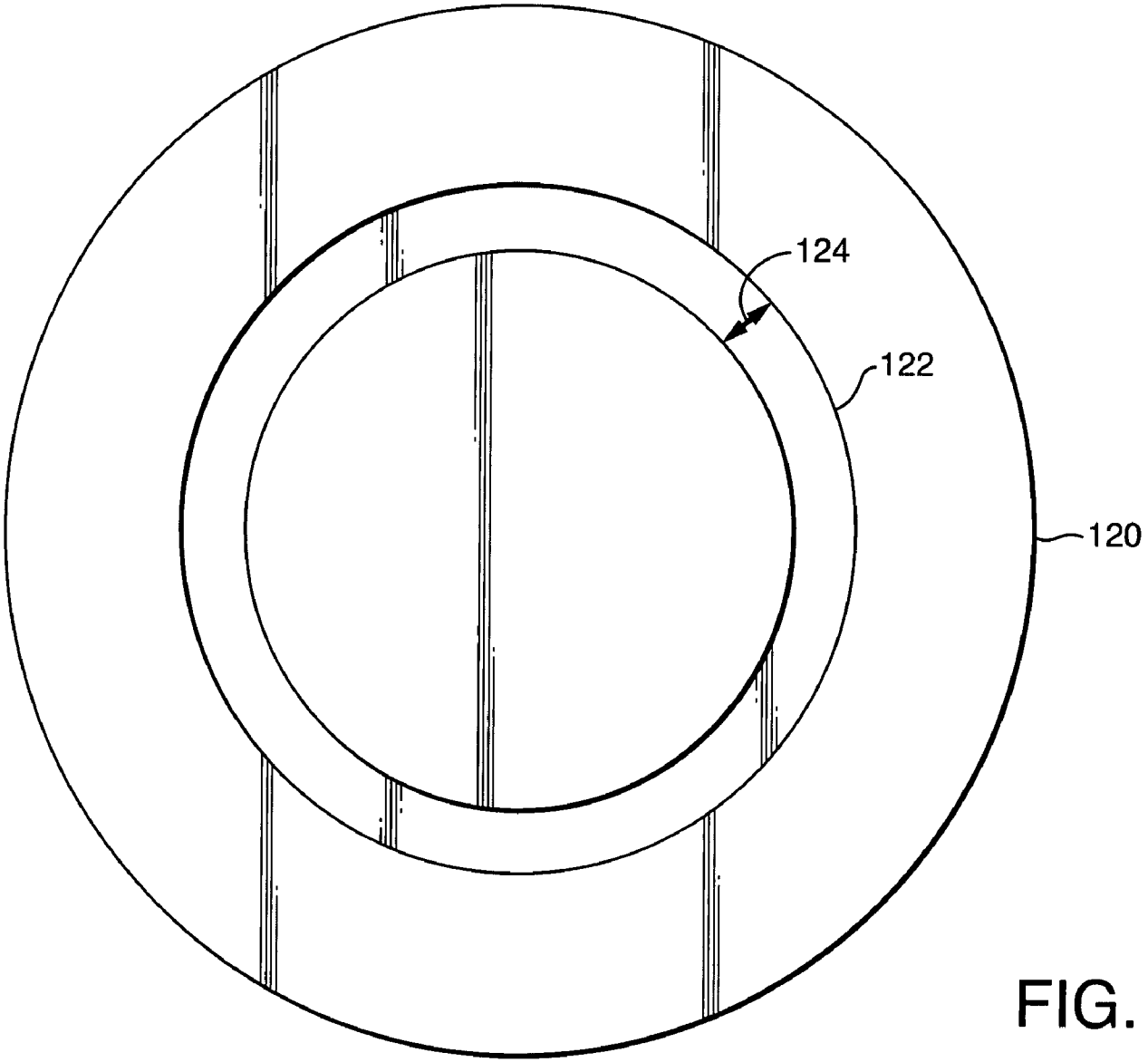
FIG. 15 shows a front end view of an electrode head with a front ring recess groove.

FIG. 14 shows a front end view of an electrode head 110 with an axial recess groove 112. The recessed groove may extend axially along the side of the electrode head. FIG. 15 shows a front end view of an electrode head 120 with a front ring recess groove 122. The ring recess 122 formed on the front face of the electrode has a spanning width 124 and a depth that comply with the above conditions.

Lamps with the electrodes and fill gases described in the previous embodiments may be advantageously run with a square-wave excitation (current) to extend the upper range of stem diameters or heat input for diffuse mode operation. Square wave excitation may allow further improvements in maintenance by having a less constrained limit on tip diameter while still achieving diffuse mode operation. Similarly, lamps with a cathode and fill gases described in the previous embodiments may be advantageously run with a DC ballast to further extend the upper range of stem diameters or heat input for diffuse mode operation. DC operation may allow even further improvements in maintenance by having an even less constrained limit on stem diameter while still achieving diffuse mode operation. Lamps with a cathode and fill gases described in the previous embodiments may be advantageously run on an AC ballast, with quasi-DC phases during starting to double the effective hollow-cathode heating effect compared to AC starting. AC operation with ballast with quasi-DC starting phases decreases glow-to-arc times and improves maintenance.

In general, the electrode with a discharge generating recess is not restricted to the geometric configurations of the embodiments disclosed but also includes recesses with alternative geometries such as spiral or diagonal or any other configuration consistent with the disclosed guidelines.

The preferred electrode design uses a single piece of formed or machined tungsten that has improved starting and steady state maintenance. The lack of a coil improves the repeatability of the electrode characteristics and therefore the lamp-to-lamp variation in lifetime. The embodiment may be operated on sine wave or square-wave a ballasts, but is not restricted to these waveforms. Finally, the design is useful in dimming applications, where at low current, electrodes without emitter oxides can go into an undesirable spot attachment and produce poor maintenance.

While there have been shown and described what are at present considered to be the preferred embodiments of the electrode structure, it will be apparent to those skilled in the art that various changes and modifications can be made herein without departing from the scope of the invention defined by the appended claims.

What is claimed is:

1. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure.

2. The lamp in claim 1, wherein the recess has the form of a bore extending into a side of the head.

3. The lamp in claim 1, wherein the recess has the form of a bore extending into a front side of the head.

4. The lamp in claim 1, wherein the recess has the form of a radial groove.

5. The lamp in claim 1, wherein the recess has varying spanning dimensions.

6. The lamp in claim 1, wherein the recess has the form of a spiral groove.

7. The lamp in claim 1, wherein the recess has the form of an axial groove.

8. The lamp in claim 1, wherein the recess has a spanning distance S and the fill gas is argon with a cold fill pressure p and recess depth D and, $$S<D$$

where

S=the spanning distance of the recess in centimeters

D=the depth of the recess in centimeters.

9. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure, and wherein the fill gas is argon with a cold (300K) pressure p such that 70 Pa-cm<Sp<1200 Pa-cm.

10. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure, and wherein the spanning distance S is less than the recess depth D.

11. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess death of D where S is greater than the electron ionization mean free path, and less than twice the minimum cathode fall distance plus the negative glow distance, during the glow discharge phase of starting, for the chosen lamp fill gas composition and (cold) fill gas pressure, and having an electrode wherein the head has an outer diameter $d_1$ and thermal conductivity $\kappa_1$ and having a stem with a diameter $d_N$ and thermal conductivity $\kappa_N$, and:

$$\kappa_1 d_1 > \kappa_N d_N$$

where:

$\kappa_1$=the thermal conductivity of the electrode head in Watts/cm/degree K $d_1$=diameter of the electrode head in cm.

$\kappa_N$=the thermal conductivity of the stem in Watts/cm/degree K $d_N$=diameter of the electrode stem in cm.

12. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure, and wherein the recess has a spanning distance S and the fill gas is helium with a cold fill pressure p and, $530<Sp<15000$ Pa-cm.

13. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure, and wherein the recess has a spanning distance S and the fill gas is neon with a cold fill pressure p and, $240$ Pa-cm$<Sp<4800$ Pa-cm.

14. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure, and wherein the recess has a spanning distance S and the fill gas is argon with a cold fill pressure p and, $70$ Pa-cm$<Sp<1200$ Pa-cm.

15. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure, and wherein the recess has a spanning distance S and the fill gas is krypton with a cold fill pressure p and, $40$ Pa-cm$<Sp<880$ Pa-cm.

16. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure, and wherein the recess has a spanning distance S and the fill gas is xenon with a cold fill pressure p and, $35$ Pa-cm$<Sp<840$ Pa-cm.

17. A high intensity discharge lamp comprising:

a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure, and having an inert gas fill of argon, krypton, or xenon with a cold fill pressure p, wherein $$N_s A_r / I_{ss} > 0.012 \text{ cm}^2/\text{Amp}$$

where $N_r$=the number of recesses $A_r$=the area of the recesses $I_{ss}$=the nominal steady-state lamp rms current in amps after formation of the thermionic arc, (either DC or AC).

18. A method of operating a high intensity discharge lamp having a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a recess with sides having an area and defining a recess volume and defining an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure; comprising the steps of:

a) providing a starting power in the cathode phase such that $$P_{hc} > 2500\ N_s A_r \text{ (watts)}$$

for a sufficient period to generate a glow discharge in the recess; and b) subsequently following the starting power from the ballast with a steady state rms current $I_{ss}$ to the lamp from the ballast to generate an arc discharge such that $$\text{Area}/I_{ss} > 0.012 \text{ cm}^2/\text{Amp}$$

where $P_{hc}$=the applied power from the ballast to the lamp in the cathode portion of an AC cycle or to the cathode in a DC cycle;

Area=the total wall area of the sides facing the recess in square centimeters, and $I_{ss}$=the steady state rms current in Amps applied from the ballast to the lamp.

19. A method of operating a high intensity discharge lamp having a light transmissive lamp envelope having a wall defining an enclosed volume;

at least one electrode assembly extending in a sealed fashion from the exterior of the lamp through the lamp envelope wall to be exposed at an inner end of the electrode assembly to the enclosed volume;

a fill material enclosed in the enclosed volume, the fill material being excitable to light emission with the application of electric power;

a fill gas enclosed in the enclosed volume, the fill gas having a cold fill pressure of p in Pascals;

wherein the inner end of the electrode has an integrally formed body (head) having a surface defining a plurality of N similar recesses each with side walls defining a recess area and a recess volume and an opening from the recess volume to the enclosed volume, further defining a least recess spanning dimension S measured across the recess opening and defining a recess depth of D where S is greater than the electron ionization mean free path, and less than twice the minimum cathode fall distance plus the negative glow distance, during the glow discharge phase of starting, for the chosen lamp fill gas composition and (cold) fill gas pressure;

comprising the steps of:

a) providing a starting power in the cathode phase such that $$P_{hc} > 2500\ N_s A_r \text{ (watts)}$$

for a sufficient period to generate a glow discharge in the recess; and b) subsequently following the starting power from the ballast with a steady state rms current $I_{ss}$ to the lamp from the ballast to generate an arc discharge such that $$N_s A_r / I_{ss} > 0.012 \text{ cm}^2/\text{Amp}$$

where $P_{hc}$=the applied power from the ballast to the lamp in the cathode portion of an AC cycle or to the cathode in a DC cycle;

$A_r$=the area of the sides of a single recess in square centimeters $N_s$=the number of recesses on the head;

$I_{ss}$=the steady state rms current in Amps.

* * * * *